US011224324B2

(12) United States Patent
Conrad et al.

(10) Patent No.: US 11,224,324 B2
(45) Date of Patent: Jan. 18, 2022

(54) HANDHELD SURFACE CLEANING APPARATUS

(71) Applicant: Omachron Intellectual Property Inc., Hampton (CA)

(72) Inventors: Wayne Ernest Conrad, Hampton (CA); Daniel Innes, West Roxbury, MA (US); Andre D. Brown, Natick, MA (US); Jason Thorne, Dover, MA (US)

(73) Assignee: Omachron Intellectual Property Inc., Hampton (CA)

( * ) Notice: Subject to any disclaimer, the term of this patent is extended or adjusted under 35 U.S.C. 154(b) by 194 days.

(21) Appl. No.: 16/541,791

(22) Filed: Aug. 15, 2019

(65) Prior Publication Data

US 2021/0045605 A1 Feb. 18, 2021

(51) Int. Cl.

| | |
|---|---|
| ***A47L 9/32*** | (2006.01) |
| ***A47L 9/28*** | (2006.01) |
| ***A47L 9/16*** | (2006.01) |
| ***A47L 5/24*** | (2006.01) |

(52) U.S. Cl.

CPC ..... *A47L 9/322* (2013.01); *A47L 9/1608* (2013.01); *A47L 9/1683* (2013.01); *A47L 9/2842* (2013.01); *A47L 5/24* (2013.01); *A47L 9/1691* (2013.01)

(58) Field of Classification Search

CPC . A47L 9/32; A47L 9/322; A47L 9/325; A47L 9/122; A47L 9/16; A47L 9/1608; A47L 9/1616; A47L 9/1625; A47L 9/1683; A47L 9/2836; A47L 9/2842; B01D 45/08; B01D 45/10; B01D 53/24; B01D 45/14; B01D 45/12; B01D 45/16; B04C 5/04; B04C 5/13; B04C 5/185; B04C 5/187; B04C 5/24; B04C 5/26; B04C 9/00; B04C 2009/005; B04C 5/081

USPC ..... 15/344, 347

See application file for complete search history.

(56) References Cited

U.S. PATENT DOCUMENTS

| | | | |
|---|---|---|---|
| 8,387,204 | B2 | 3/2013 | Dyson |
| 9,314,139 | B2 | 4/2016 | Conrad et al. |
| 9,370,285 | B2 | 6/2016 | Visel et al. |
| 9,591,958 | B2 | 3/2017 | Conrad |
| 9,888,817 | B2 | 2/2018 | Conrad |
| 9,986,880 | B2 | 6/2018 | Conrad |
| 10,165,915 | B2 | 1/2019 | Conrad et al. |

(Continued)

FOREIGN PATENT DOCUMENTS

| | | | |
|---|---|---|---|
| CA | 2971067 | A1 | 7/2017 |
| CN | 205251427 | U | 5/2016 |

(Continued)

OTHER PUBLICATIONS

CN-205625805-U translation Espacenet (Year: 2021).*

(Continued)

*Primary Examiner* — Joseph J Hail
*Assistant Examiner* — Timothy B Brady
(74) *Attorney, Agent, or Firm* — Philip C. Mendes da Costa; Bereskin & Parr LLP/S.E.N.C.R.L., s.r.l.

(57) ABSTRACT

A hand vacuum cleaner wherein a pre-motor filter, the suction motor, the energy storage unit and the pistol grip handle are substantially located within a volume defined by a projection of the air treatment member sidewall.

18 Claims, 15 Drawing Sheets

(56) References Cited

U.S. PATENT DOCUMENTS

| | | | |
|---|---|---|---|
| 10,258,210 | B2 | 4/2019 | Conrad |
| 2009/0313958 | A1 | 12/2009 | Gomiciaga-Pereda et al. |
| 2010/0115726 | A1 | 5/2010 | Groff et al. |
| 2017/0280950 | A1 | 10/2017 | Nam et al. |
| 2017/0280951 | A1 | 10/2017 | Nam et al. |
| 2017/0280952 | A1 | 10/2017 | Nam et al. |
| 2017/0280959 | A1 | 10/2017 | Nam et al. |
| 2017/0290480 | A1 | 10/2017 | Conrad |
| 2017/0332860 | A1 | 11/2017 | Nam et al. |
| 2019/0008338 | A1 | 1/2019 | Conrad |
| 2019/0174984 | A1* | 6/2019 | Machida ..... A47L 9/242 |
| 2019/0357741 | A1 | 11/2019 | Conrad |
| 2020/0129028 | A1* | 4/2020 | Rougher ..... A47L 9/2884 |

FOREIGN PATENT DOCUMENTS

| | | | | |
|---|---|---|---|---|
| CN | 205625805 | U | * | 10/2016 |
| CN | 205671987 | U | | 11/2016 |
| CN | 106343919 | A | | 1/2017 |
| CN | 206138051 | U | | 5/2017 |
| CN | 106974586 | A | | 7/2017 |
| CN | 106993983 | A | | 8/2017 |
| CN | 108209714 | A | * | 6/2018 |
| CN | 109330476 | A | * | 11/2018 |
| DE | 102014200663 | A1 | | 7/2014 |
| GB | 2476776 | B | | 7/2012 |
| WO | 2010048305 | A2 | | 4/2010 |
| WO | 2016065151 | A1 | | 4/2016 |
| WO | 2017046560 | A1 | | 3/2017 |
| WO | 2017181041 | A3 | | 12/2017 |
| WO | 2018119510 | A1 | | 7/2018 |
| WO | 2019006543 | A1 | | 1/2019 |

OTHER PUBLICATIONS

CN-108209714-A translation Espacenet (Year: 2021).*
CN-109330476-A translation Espacenet (Year: 2021).*
International Search Report and Written Opinion, received in connection to international patent application No. PCT/CA2020/051068, dated Nov. 6, 2020.

* cited by examiner

HANDHELD SURFACE CLEANING APPARATUS

FIELD

This disclosure relates generally to surface cleaning apparatus. In a preferred embodiment, the surface cleaning apparatus comprises a portable surface cleaning apparatus, such as a hand vacuum cleaner.

INTRODUCTION

The following is not an admission that anything discussed below is part of the prior art or part of the common general knowledge of a person skilled in the art.

Various types of surface cleaning apparatus are known, including upright surface cleaning apparatus, canister surface cleaning apparatus, stick surface cleaning apparatus, central vacuum systems, and hand carriable surface cleaning apparatus such as hand vacuums. Further, various designs for cyclonic hand vacuum cleaners, including battery operated cyclonic hand vacuum cleaners, are known in the art.

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

In accordance with one aspect of this disclosure, which may be used alone or in combination with any other aspect, a hand vacuum cleaner includes an energy storage unit at its lower end. The hand vacuum cleaner has a pistol grip handle located above the rear end of the energy storage unit and a suction motor located above the front end of the energy storage unit. This configuration of the heavier components of the hand vacuum cleaner and the handle allows a user to easily wield the hand vacuum cleaner with one hand and provides a comfortable hand feel.

The energy storage unit may include multiple energy storage members arranged in a row extending in a forward/rearward direction. This may further enhance the weight distribution of the hand vacuum cleaner by spreading out the weight of the energy storage unit.

In accordance with this broad aspect, there is provided a hand vacuum cleaner having an upper end, a lower end, a front end having a dirty air inlet and a rear end, the hand vacuum cleaner comprising:

(a) an air flow path extending from the dirty air inlet to a clean air outlet;

(b) an air treatment member positioned in the air flow path, the air treatment member having a front end and a rear end and an axis that extends between the front and rear ends of the air treatment member;

(c) an energy storage unit having a front end and a rear end;

(d) a suction motor positioned in the air flow path; and, (e) a pistol grip handle, wherein when the hand vacuum cleaner is oriented with the upper end above the lower end, the pistol grip handle is located at the rear end of the hand vacuum cleaner, the energy storage unit is located at the lower end of the hand vacuum cleaner with the suction motor located above the front end of the energy storage unit and the pistol grip handle located above the rear end of the energy storage unit.

In some embodiments, the hand vacuum cleaner may include a finger grip area where, when the hand vacuum cleaner is oriented with the upper end above the lower end, the finger grip area is positioned forward of the pistol grip handle and above the energy storage unit.

In some embodiments, the finger grip area may be positioned between the front end and the rear end of the energy storage unit.

In some embodiments, the energy storage unit may include a plurality of energy storage members and a line that extends through at least some of the energy storage members may be substantially parallel to the air treatment member axis.

In some embodiments, the energy storage unit may include a plurality of energy storage members, the energy storage members may have a longitudinal axis and the energy storage members may be oriented with the longitudinal energy storage member axis extending transverse to the air treatment member axis.

In some embodiments, the energy storage members may be arranged in a single extending row extending in a forward/rearward direction.

In some embodiments, the energy storage members may be arranged in a single extending row extending in a forward/rearward direction.

In some embodiments, the energy storage unit may include a plurality of energy storage members and when the hand vacuum cleaner is oriented with the upper end above the lower end, at least one of the energy storage members may underlie the suction motor and at least another of the energy storage members may underlie the pistol grip handle.

In some embodiments, the air treatment member may include a cyclone and the air treatment member axis may be a cyclone axis of rotation.

In some embodiments, the suction motor may have an axis of rotation and the suction motor axis of rotation may be substantially parallel to the air treatment member axis.

In some embodiments, the suction motor may be positioned rearward of a pre-motor filter and forward of the pistol grip handle.

In some embodiments, the hand vacuum cleaner may include a finger grip area where, the finger grip area is positioned between the suction motor and the pistol grip handle.

In some embodiments, the hand vacuum cleaner may include a second stage cyclone downstream from the air treatment member where the second stage cyclone is located between the air treatment member and the suction motor.

In some embodiments, the hand vacuum cleaner may include a pre-motor filter where the pre-motor filter is located forward of the energy storage unit.

In some embodiments, a forward projection of the energy storage unit may intersect the pre-motor filter.

In some embodiments, the air treatment member and a pre-motor filter may include a removable air treatment unit that is located forward of the energy storage unit.

In some embodiments, the air treatment member may have a front openable door.

In some embodiments, the air treatment member may be removably mounted at a location forward of the energy storage unit.

In accordance with another aspect of this disclosure, which may be used alone or in combination with any other aspect, a hand vacuum cleaner may have a cyclone chamber and a dirt collection chamber external to the cyclone chamber. A rearward projection of the dirt collection chamber sidewall may enclose or substantially enclose the pre-motor filter, suction motor, energy storage unit, and handle of the hand vacuum cleaner, and optionally a post motor filter. The generally linear arrangement of components within the hand vacuum cleaner may allow the height of the hand vacuum cleaner to be reduced while reducing backpressure through the hand vacuum cleaner, which may improve maneuverability and cleanability and make it easier to clean hard-to-reach areas.

In accordance with this broad aspect, there is provided a hand vacuum cleaner having an upper end, a lower end, a front end having a dirty air inlet and a rear end, the hand vacuum cleaner comprising:

(a) an air flow path extending from the dirty air inlet to a clean air outlet;

(b) a cyclone positioned in the air flow path, the cyclone having a cyclone front end, a cyclone rear end, a cyclone air inlet, a cyclone air outlet and a cyclone axis of rotation axis extending between the cyclone front end and the cyclone rear end;

(c) a dirt collection chamber external to the cyclone and surrounding at least 80% of the cyclone; and (d) a main body comprising a suction motor that is positioned in the air flow path, a plurality of energy storage members and a pistol grip handle, the pistol grip handle having an upper end and a lower end, wherein a line that extends through the plurality of energy storage members is substantially parallel to the cyclone axis of rotation, and wherein when the hand vacuum cleaner is oriented with the upper end above the lower end, the suction motor is located rearward of a pre-motor filter, the pistol grip handle is located at the rear end of the hand vacuum cleaner and the plurality of energy storage members are located at the lower end of the hand vacuum cleaner, and wherein a pre-motor filter, the suction motor, the energy storage unit and the pistol grip handle are substantially located within a volume defined by a projection of the dirt collection chamber sidewall.

In some embodiments, when the hand vacuum cleaner is oriented with the upper end above the lower end, the energy storage members may be located below the pistol grip handle.

In some embodiments, the energy storage unit may include a plurality of energy storage members and when the hand vacuum cleaner is oriented with the upper end above the lower end, the energy storage members may be located below the suction motor.

In some embodiments, when the hand vacuum cleaner is oriented with the upper end above the lower end, the energy storage members may be located below the pistol grip handle.

In accordance with this broad aspect, there is also provided a hand vacuum cleaner having an upper end, a lower end, a front end having a dirty air inlet and a rear end, the hand vacuum cleaner comprising:

(a) an air flow path extending from the dirty air inlet to a clean air outlet;

(b) a cyclone positioned in the air flow path, the cyclone having a cyclone first end, an opposed cyclone second end, a cyclone air inlet, a cyclone air outlet, a cyclone axis of rotation axis extending between the cyclone first end and the cyclone second end and an axially extending cyclone sidewall;

(c) a dirt collection chamber external to the cyclone and surrounding the cyclone; and (d) a main body comprising a suction motor that is positioned in the air flow path, an energy storage unit and a pistol grip handle, the pistol grip handle having an upper end and a lower end, wherein when the hand vacuum cleaner is oriented with the upper end above the lower end, the pistol grip handle is located rearward of the front end of the hand vacuum cleaner and the suction motor is located rearward of a pre-motor filter, and wherein a pre-motor filter, the suction motor, the energy storage unit and the pistol grip handle are substantially located within a volume defined by a projection of the dirt collection chamber sidewall.

In some embodiments, the energy storage unit may be provided at the lower end of the hand vacuum cleaner.

In some embodiments, when the hand vacuum cleaner is oriented with the upper end above the lower end, the energy storage unit may be located below the pistol grip handle.

In some embodiments, the energy storage unit may include a plurality of energy storage members and a line that extends through at least some of the energy storage members may be substantially parallel to the cyclone axis of rotation.

In some embodiments, the energy storage unit may include a plurality of energy storage members and when the hand vacuum cleaner is oriented with the upper end above the lower end, the suction motor may be located above at least some of the energy storage members.

In some embodiments, the pistol grip handle may be located at the rear end of the hand vacuum cleaner.

In some embodiments, the hand vacuum cleaner may include an air inlet conduit extending downstream from the dirt air inlet, the air inlet conduit having an inlet conduit axis where a projection of the inlet conduit intersects the upper end of the handle.

In some embodiments, the hand vacuum cleaner may include a second cyclonic stage downstream from the cyclone where the second cyclonic stage is located within the volume defined by a projection of the dirt collection chamber sidewall.

In accordance with this broad aspect, there is also provided a hand vacuum cleaner having an upper end, a lower end, a front end having a dirty air inlet and a rear end, the hand vacuum cleaner comprising:

(a) an air flow path extending from the dirty air inlet to a clean air outlet;

(b) a cyclone unit comprising a cyclone positioned in the air flow path and a dirt collection chamber external to the cyclone chamber, the cyclone having a cyclone front end, a cyclone rear end, a cyclone air inlet, a cyclone air outlet and a cyclone axis of rotation axis extending between the cyclone front end and the cyclone rear end, the cyclone unit having an axially extending sidewall; and (c) a main body comprising a suction motor positioned in the air flow path, an energy storage unit and a pistol grip handle, wherein when the hand vacuum cleaner is oriented with the upper end above the lower end, the suction motor is located rearward of a pre-motor filter, the pistol grip handle is located at the rear end of the hand vacuum cleaner and the energy storage unit is located at the lower end of the hand vacuum cleaner, and wherein a projection of the cyclone chamber and dirt collection chamber sidewalls substantially encompasses a pre-motor filter, the suction motor, the energy storage unit and the pistol grip handle.

In some embodiments, when the hand vacuum cleaner is oriented with the upper end above the lower end, the energy storage unit may be located below the pistol grip handle.

In some embodiments, the energy storage unit may include a plurality of energy storage members and a line that extends through at least some of the energy storage members may be substantially parallel to the cyclone axis of rotation.

In some embodiments, the energy storage unit may include a plurality of energy storage members and when the hand vacuum cleaner is oriented with the upper end above the lower end, the suction motor may be located above at least some of the energy storage members.

In some embodiments, the hand vacuum cleaner may include an air inlet conduit extending downstream from the dirt air inlet, the air inlet conduit having an inlet conduit axis wherein a projection of the inlet conduit may intersect the upper end of the handle.

In some embodiments, the hand vacuum cleaner may include a second cyclonic stage downstream from the cyclone wherein the second cyclonic stage may be located within the volume defined by a projection of the cyclone chamber and dirt collection chamber sidewalls.

In some embodiments, at least 75%, 80%, 85%, 90% or 95% of the pre-motor filter, the suction motor, the energy storage unit and the pistol grip handle may be located within the volume defined by a projection of the cyclone chamber and dirt collection chamber sidewalls.

In some embodiments, the energy storage unit may include a plurality of energy storage members and when the hand vacuum cleaner is oriented with the upper end above the lower end, at least some of the energy storage members may be located below the suction motor.

It will be appreciated by a person skilled in the art that an apparatus or method disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
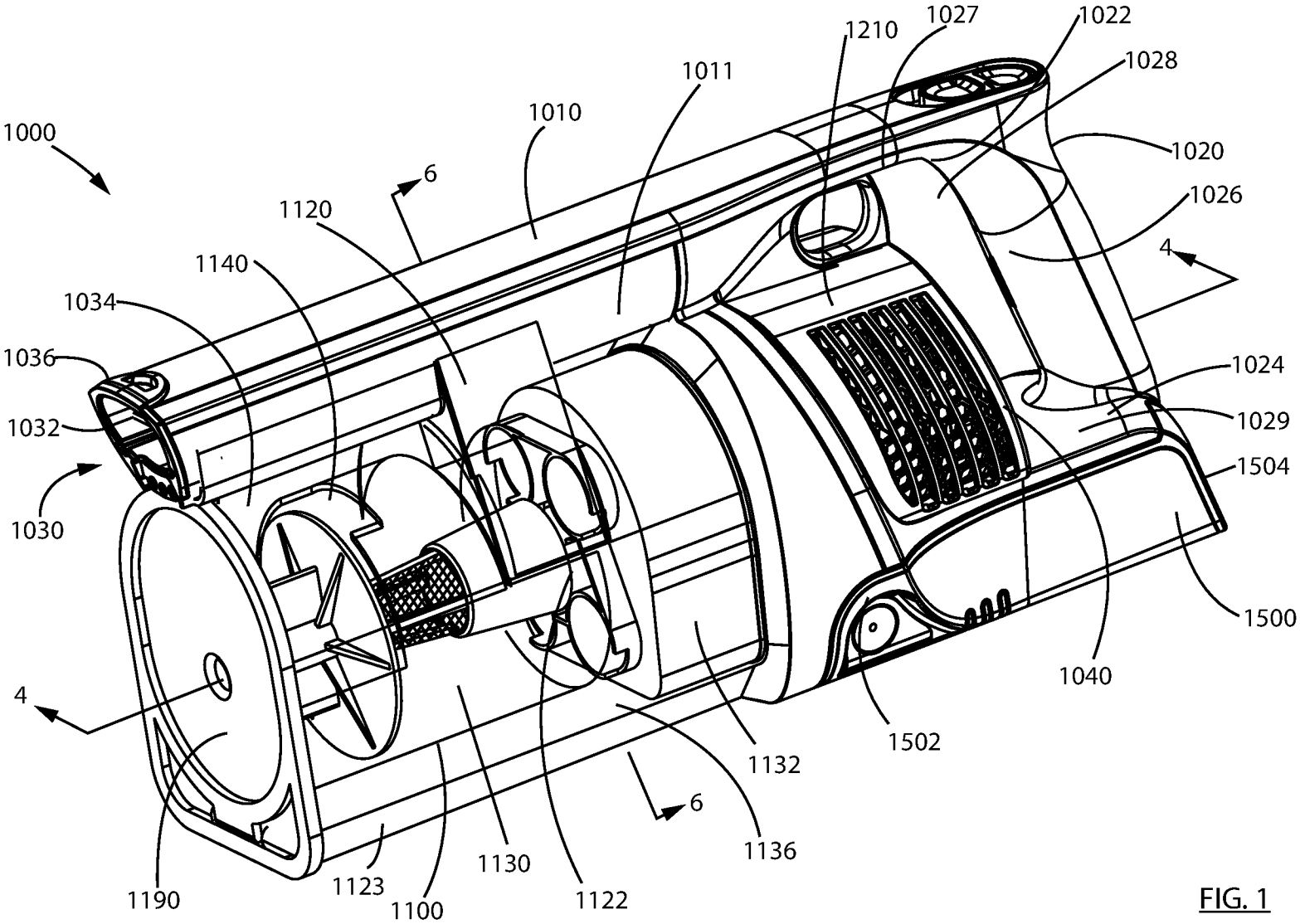
FIG. 1 is a top front perspective view of a hand vacuum cleaner in accordance with one embodiment.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. None of the terms "coupled", "connected", "attached", and "fastened" distinguish the manner in which two or more parts are joined together.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

Referring to FIGS. 1 to 16, exemplary embodiments of a surface cleaning apparatus is shown generally as 1000. In the illustrated embodiment, the surface cleaning apparatus is a hand vacuum cleaner, which may also be referred to as a "handvac" or "hand-held vacuum cleaner". As used herein, a hand vacuum cleaner is a vacuum cleaner that can be operated to clean a surface generally one-handedly. That is, the entire weight of the vacuum may be held by the same one hand used to direct a dirty air inlet of the vacuum cleaner with respect to a surface to be cleaned. For example, the handle and a clean air inlet may be rigidly coupled to each other (directly or indirectly) so as to move as one while maintaining a constant orientation relative to each other. This is to be contrasted with canister and upright vacuum cleaners, whose weight is typically supported by a surface (e.g. a floor) during use.

Optionally, surface cleaning apparatus 1000 may be removably mountable on a base so as to form, for example, an upright vacuum cleaner, a canister vacuum cleaner, a stick vacuum cleaner or stick vac, a wet-dry vacuum cleaner and the like. For example, the base of the surface cleaning apparatus may include a surface cleaning head and an elongate wand that can be connected to the hand vacuum 1000. In this configuration, the surface cleaning apparatus may be used to clean a floor or other surface in a manner analogous to a conventional upright-style vacuum cleaner.

As exemplified in FIGS. 1 to 6, surface cleaning apparatus 1000 includes a main body 1010 having a housing 1011 and a handle 1020, an air treatment member 1100 connected to the main body 1010, a dirty air inlet 1030, a clean air outlet 1040, and an air flow path extending between the dirty air inlet 1030 and the clean air outlet 1040. The air treatment member 1100 is positioned in the air flow path.

Surface cleaning apparatus 1000 has a front end 1002, a rear end 1004, an upper end or top 1006, and a lower end or bottom 1008. In the embodiment shown, dirty air inlet 1030 is at an upper portion of the front end 1002 and clean air outlet 1040 is at rearward portion of the main body 1010, between the upper and lower ends 1006 and 1008. It will be appreciated that the dirty air inlet 1030 and the clean air outlet 1040 may be provided in different locations.

A suction motor 1200 (see e.g. FIGS. 4, 8, 11, 14 and 16) is positioned in the air flow path to generate vacuum suction through the air flow path. The suction motor 1200 is positioned within a motor housing 1210. In the illustrated embodiment, the suction motor 1200 is positioned downstream from the air treatment member 1100. In alternative embodiments, the suction motor 1200 may be positioned upstream of the air treatment member 1100 (e.g., a dirty air motor). The suction motor 1200 defines a motor axis 1205 (about which the rotor rotates).

Air treatment member 1100 is configured to remove particles of dirt and other debris from the air flow and/or otherwise treat the air flow. As exemplified herein, the air treatment member may comprise one or more cyclonic stages, each of which may comprise a single cyclone or a plurality of cyclones in parallel. Each cyclonic stage may have a single dirt collection chamber or a plurality of dirt collection chambers. The dirt collection chamber(s) may be external to the cyclone chamber or may be internal the cyclone chamber and configured as a dirt collection area or region within the cyclone chamber. Alternatively, the air treatment member 1100 need not include a cyclonic cleaning stage, and can incorporate a bag, a porous physical filter media (such as foam or felt), or other air treating means.

In FIGS. 1-12, the air treatment member is exemplified as a cyclone assembly having two cyclonic cleaning stages arranged in series with each other. The first stage cyclone is exemplified as having a single cyclone and the second cyclonic stage is exemplified as having a plurality of cyclones (e.g., four cyclones) in parallel. The dirt collection chambers are exemplified as being external to the cyclone chambers.

As exemplified in the embodiments shown in FIGS. 4, 6, 8 and 11, the air treatment member 1100 may comprise a two-stage cyclone assembly having a first stage cyclone 1130 and a second stage cyclone unit 1132 that is arranged in series, downstream from the first stage cyclone 1130. The cyclone assembly also includes, in this embodiment, a first stage dirt collection chamber 1134 to receive dirt separated by the first stage cyclone 1130, and a second stage dirt collection chamber 1136 to receive dirt separated by the second stage cyclone unit 1132.

The first stage cyclone chamber 1130 has a cyclone air inlet 1120 in fluid communication with the inlet conduit 1036, a cyclone air outlet 1122, and a dirt outlet 1140 that is in communication with the dirt collection chamber 1134.

The second stage cyclone unit 1132 may include a plurality of cyclone chambers 1150 arranged in parallel. In the example illustrated, there are four second stage cyclone chambers 1150 (see e.g. FIG. 1), although greater or fewer numbers of second stage cyclone chambers 1150 may be provided. Each cyclone chamber 1150 has a cyclone air inlet 1151 in fluid communication with the cyclone air outlet 1122, a cyclone air outlet 1152, and a dirt outlet 1155 that is in communication with the dirt collection chamber 1136.

Figure 4:
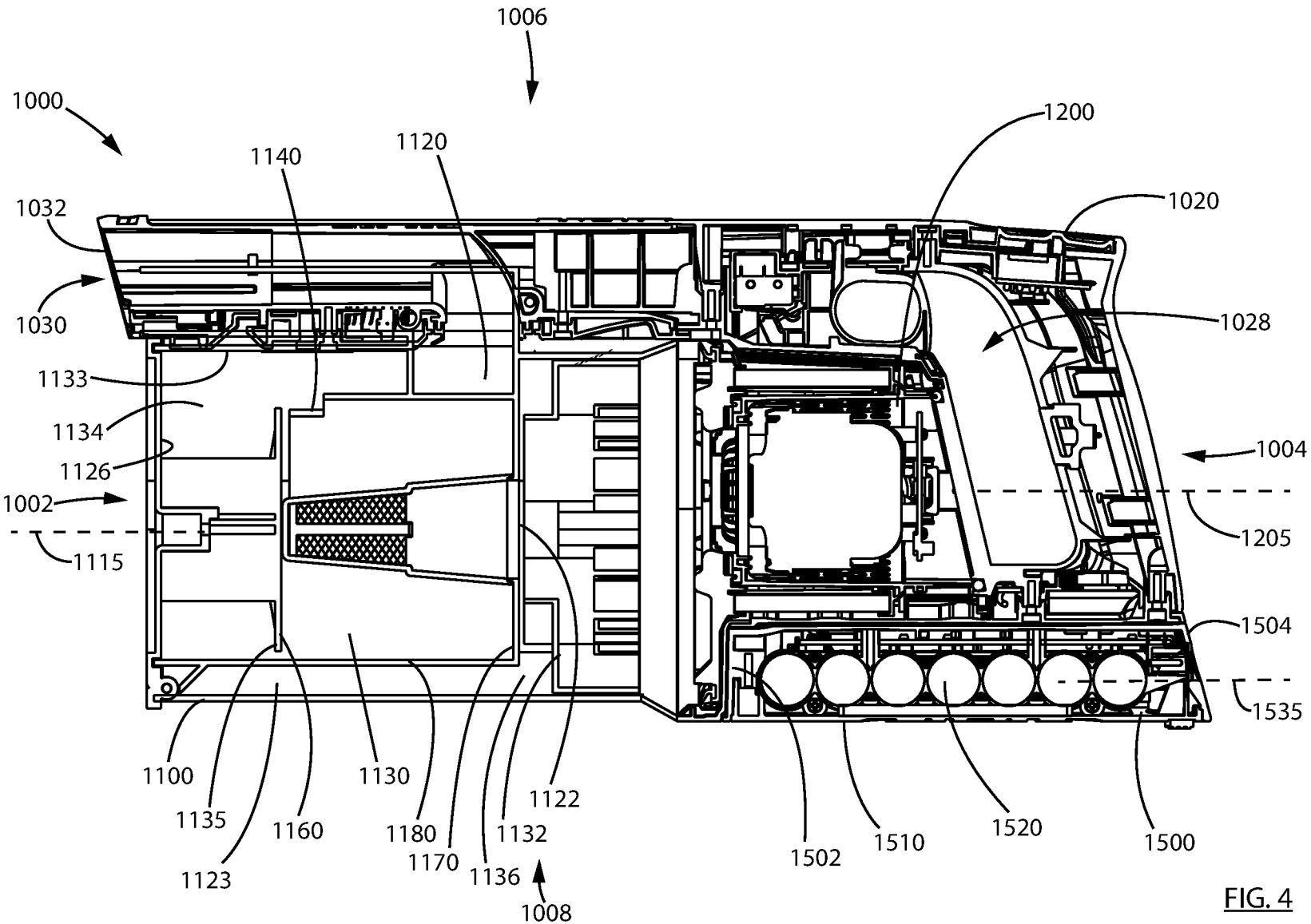
FIG. 4 is a sectional view of the hand vacuum cleaner of FIG. 1 along line 4-4 in FIG. 1 in accordance with the embodiment of FIG. 1.
Figure 8:
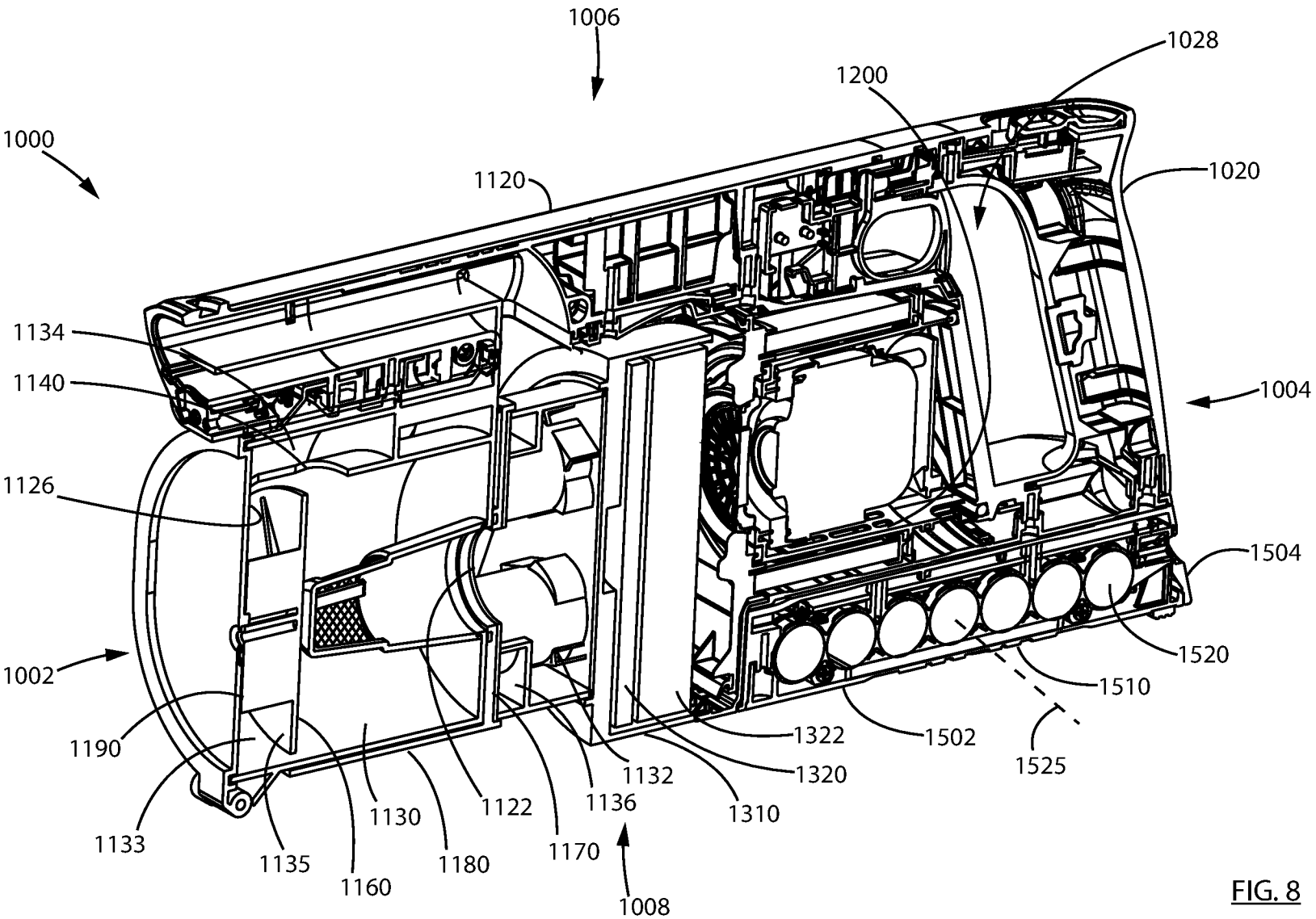
FIG. 8 is a perspective sectional view of the hand vacuum cleaner of FIG. 7 along line 8-8 in FIG. 7 in accordance with the embodiment of FIG. 6.
Figure 11:
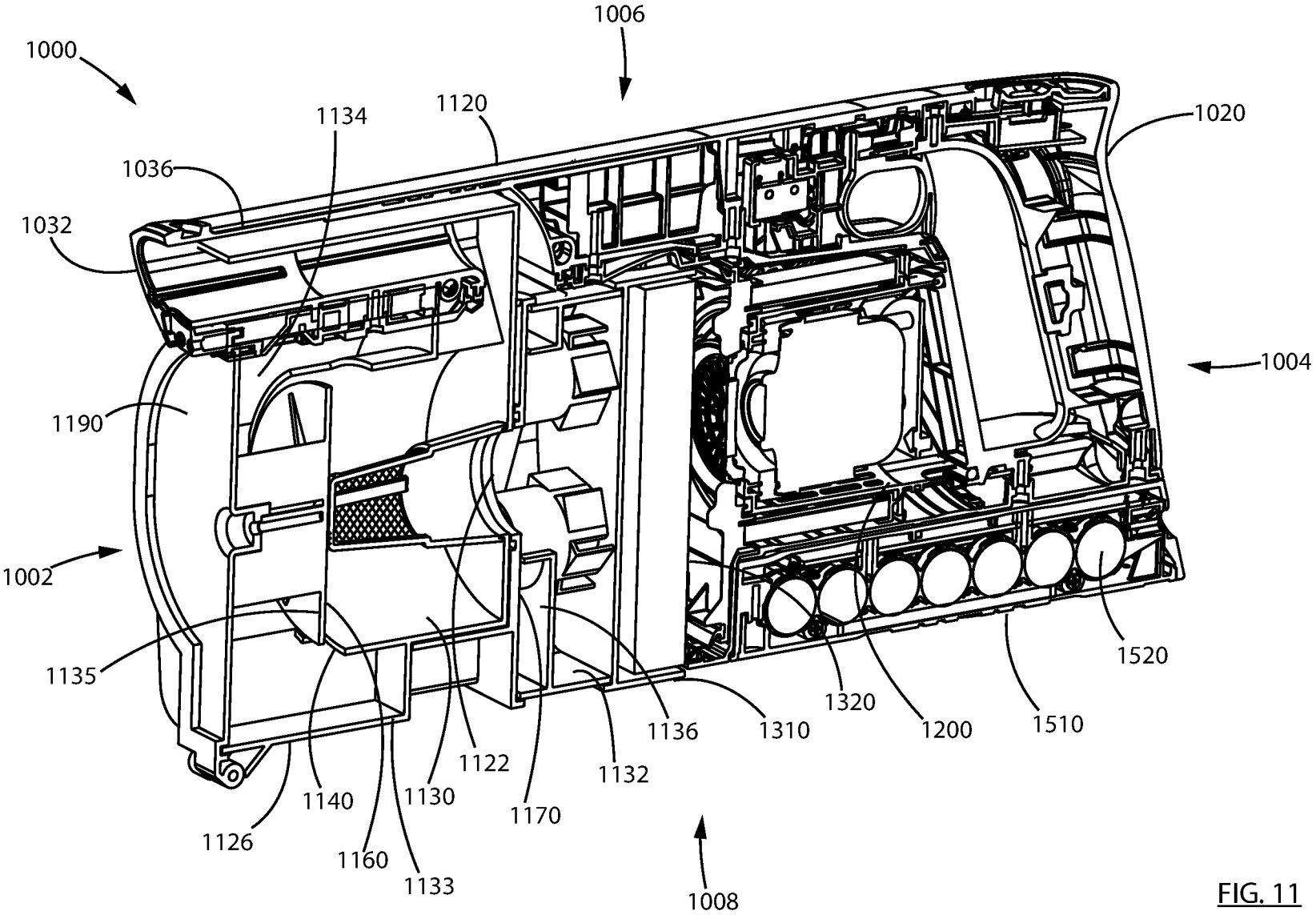
FIG. 11 is a perspective sectional view of the hand vacuum cleaner of FIG. 10 along line 11-11 in FIG. 10 in accordance with the embodiment of FIG. 10.

Optionally, as exemplified in FIGS. 4, 8 and 11, one or more of the second stage cyclone chambers 1150 may be arranged as multi-inlet cyclones. The cyclone air inlet 1151 of each multi-inlet cyclone 1150 may include a plurality of air inlet ports 1153 and, which may share a common airflow passage leading upstream from the first stage cyclone air outlet 1122. Air entering each second stage cyclone air inlet 1151 passes through the common airflow passage, then to the air inlet ports 1153 before entering the cyclone chamber 1150.

One or both of the first stage cyclone 1130 and the second stage cyclone 1132 may optionally be a 'uniflow' cyclone chamber (i.e. wherein the cyclone air inlet and cyclone air outlet are at opposite ends of the cyclone chamber). Alternatively or in addition, one or both of the first stage cyclone 1130 and the second stage cyclone 1132 may provide bidirectional air flow (i.e. where the cyclone air inlet and cyclone air outlet are at the same end of the cyclone chamber). In the examples illustrated by FIGS. 1-12, the first stage cyclone 1130 and the second stage cyclone 1132 use bidirectional air flow. Optionally, the first stage cyclone 1130 and/or the second stage cyclone 1132 may be an inverted cyclone.

The first stage cyclone 1130 defines a first cyclone axis 1115, about which air circulates when in the first stage cyclone 1130. Each cyclone chamber 1150 in the second stage cyclone unit 1132 may also define a corresponding second cyclone axis (not shown), about which air circulates when in the second stage cyclone chamber 1150. The cyclone axes of the first and second stage cyclones 1130 and 1150 may be generally parallel as in the illustrated examples. Optionally, the cyclone axes may be both parallel and co-axial with each other (e.g. where the second stage cyclone unit 1132 includes a single cyclone chamber). In other arrangements, the cyclone axes need not be parallel or co-axial with each other.

The cyclone chambers 1130 and 1150 and dirt collection chambers 1134 and 1136 may be of any configuration suitable for separating dirt from an air stream and collecting the separated dirt, respectively. The cyclone chambers 1130 and 1150 may be oriented in any direction, including those described in more detail herein. For example, when surface cleaning apparatus 1000 is oriented with the upper end 1006 above the lower end 1008, the cyclone axes may be oriented generally horizontally or horizontally as exemplified, or alternatively may be oriented vertically, or at any angle between horizontal and vertical.

Alternatively, as shown in the examples of FIGS. 13-16, air treatment member 1100 may include a cyclone assembly having a single cyclonic cleaning stage with a single cyclone chamber 1130 and a dirt collection region 1134 external to the cyclone chamber. The cyclone chamber 1130 and dirt collection region 1134 may be of any configuration suitable for separating dirt from an air stream and collecting the separated dirt, respectively.

The cyclone chamber 1130 may be oriented in any direction. For example, when surface cleaning apparatus 1000 is oriented with the upper end 1006 above the lower end 1008, e.g. positioned generally parallel to a horizontal surface, a central axis or axis of rotation 1115 of the cyclone chamber 1130 may be oriented horizontally, as exemplified in FIG. 4. In alternative embodiments, the cyclone chamber may be oriented vertically, or at any angle between horizontal and vertical.

The first stage dirt collection chamber 1136 may surround part of all of the first stage cyclone 1130. For example, as exemplified in FIGS. 6, 9 and 16, the first stage dirt collection chamber 1134 may surround only part of the first stage cyclone 1130 (e.g., the upper portion thereof). Alternately, as exemplified in FIGS. 12 and 14, the first stage dirt collection chamber 1134 may surround all of the first stage cyclone 1130.

Preferably, at least a portion of the air treatment member may be openable for emptying. For example, at least one end (e.g., the front end in the exemplified orientation), and optionally both ends (e.g., the front and rear ends in the exemplified orientation) of the dirt collection chamber 1134 may be openable for emptying. Optionally, at least one end, and optionally both ends of the cyclone chamber 1130 may also be openable for emptying.

In the examples illustrated, the front end wall 1160 of the cyclone chamber 1130 and the front end wall 1126 of the dirt collection chamber 1134 are both provided by portions of an openable front door 1190 that covers the front end of the cyclone assembly 1100. In this arrangement, opening the front door 1190 will concurrently open the front end walls 1160 and 1126 of the cyclone and dirt collection chambers 1130, 1134.

The second stage dirt collection chamber 1136 may extend forwardly through or adjacent the first stage dirt collection chamber 1134 and/or the first stage cyclone 1130 to terminate at the front end of the air treatment member 1100. Accordingly, opening the front door also opens the second stage dirt collection chamber 1136.

For example, one or more dirt collection chamber passages 1123 may extend forwardly through or adjacent the first stage dirt collection chamber 1134 and/or the first stage cyclone 1130 such that the second stage dirt collection chamber 1136 may be emptied when the first stage dirt collection chamber 1134 is opened for emptying. As exemplified in FIG. 6, a single dirt collection passage 1123 extends underneath the first stage cyclone 1130. Accordingly, when front door 1190 is opened, both the first and second dirt collection chambers 1134 and 1136 may be emptied. Similarly, as exemplified in FIG. 9, two dirt collection passages 1123*a* and 1123*b* extend underneath the first stage cyclone 1130. As exemplified in FIG. 12, two dirt collection passages 1123*a* and 1123*b* extend adjacent the outer side of the sidewall 1133 of the first stage dirt collection chamber 1134.

Figure 6:
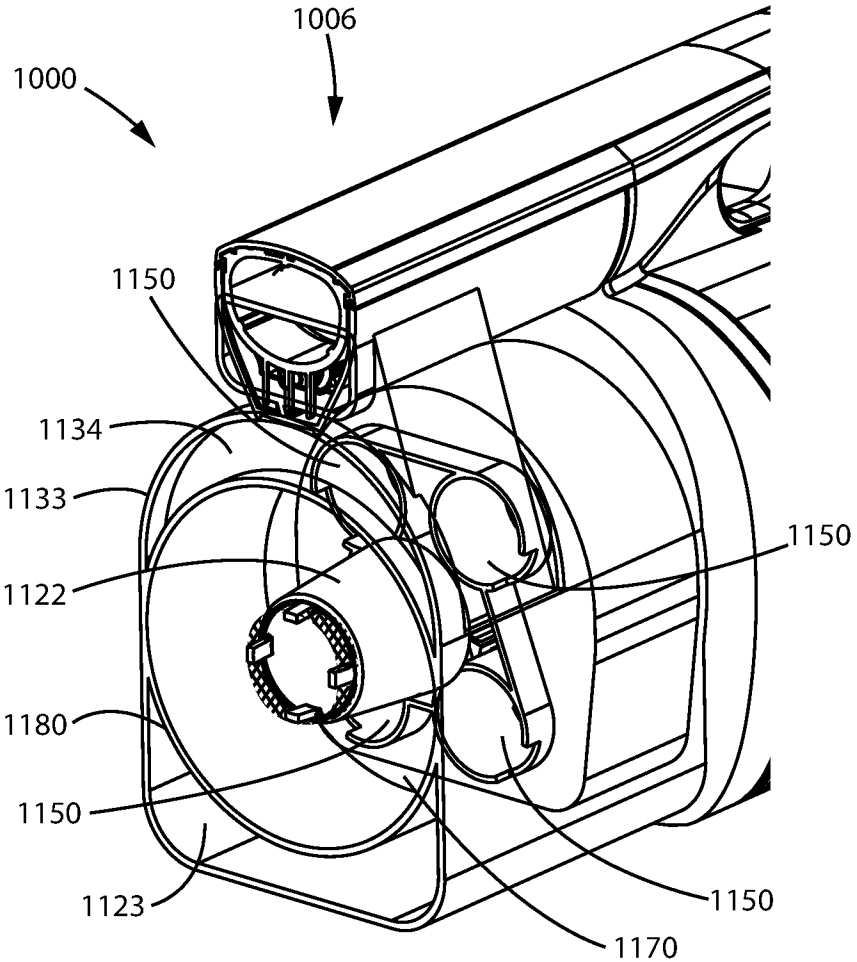
FIG. 6 is a front perspective sectional view of the hand vacuum cleaner of FIG. 1 along line 6-6 in FIG. 1 in accordance with the embodiment of FIG. 1.
Figure 5:
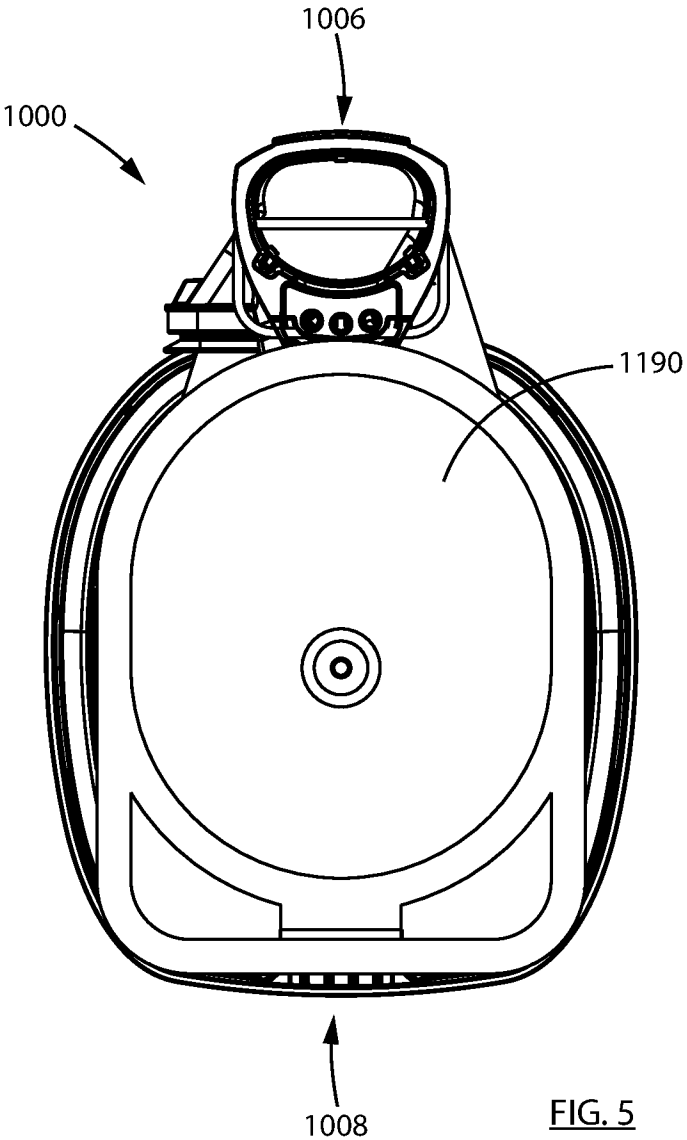
FIG. 5 is a front view of the hand vacuum cleaner of FIG. 1 in accordance with the embodiment of FIG. 1.
Figure 7:
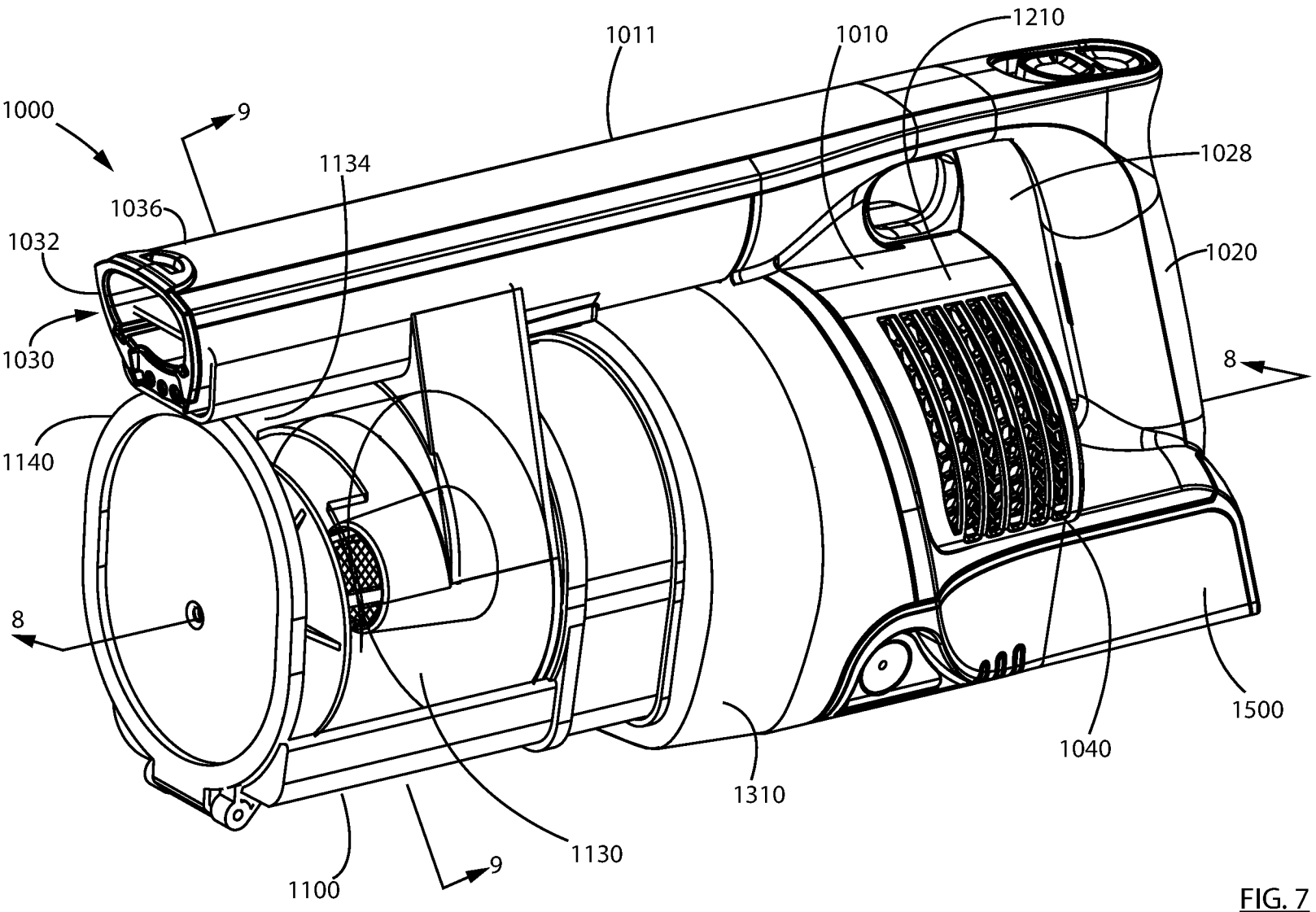
FIG. 7 is a top front perspective view of a hand vacuum cleaner in accordance with another embodiment.
Figure 9:
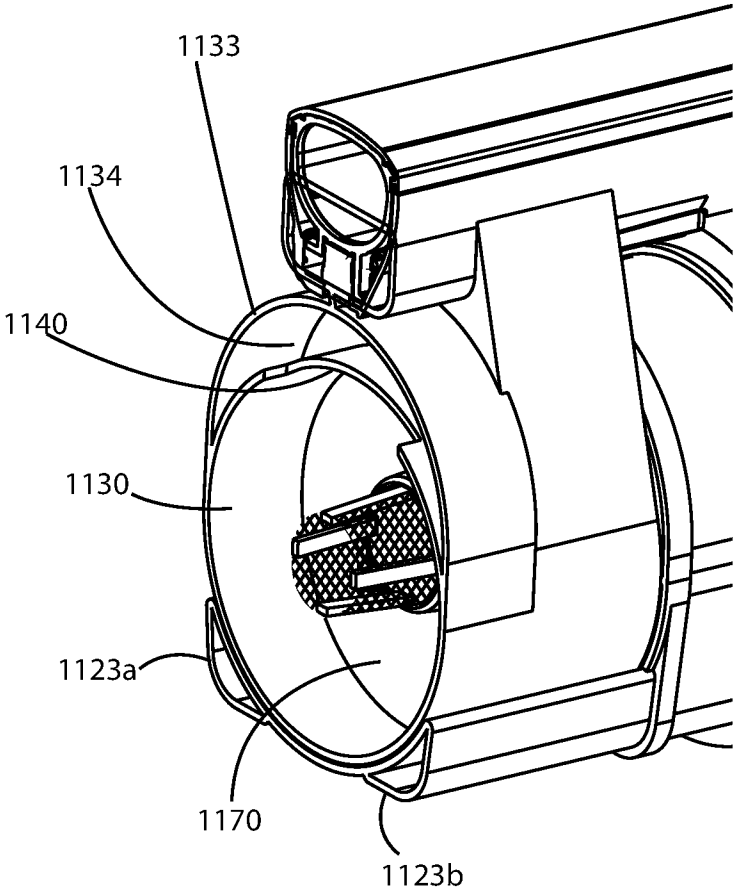
FIG. 9 is an isolated perspective sectional view of the hand vacuum cleaner of FIG. 7 along line 9-9 in FIG. 7 in accordance with the embodiment of FIG. 6.
Figure 10:
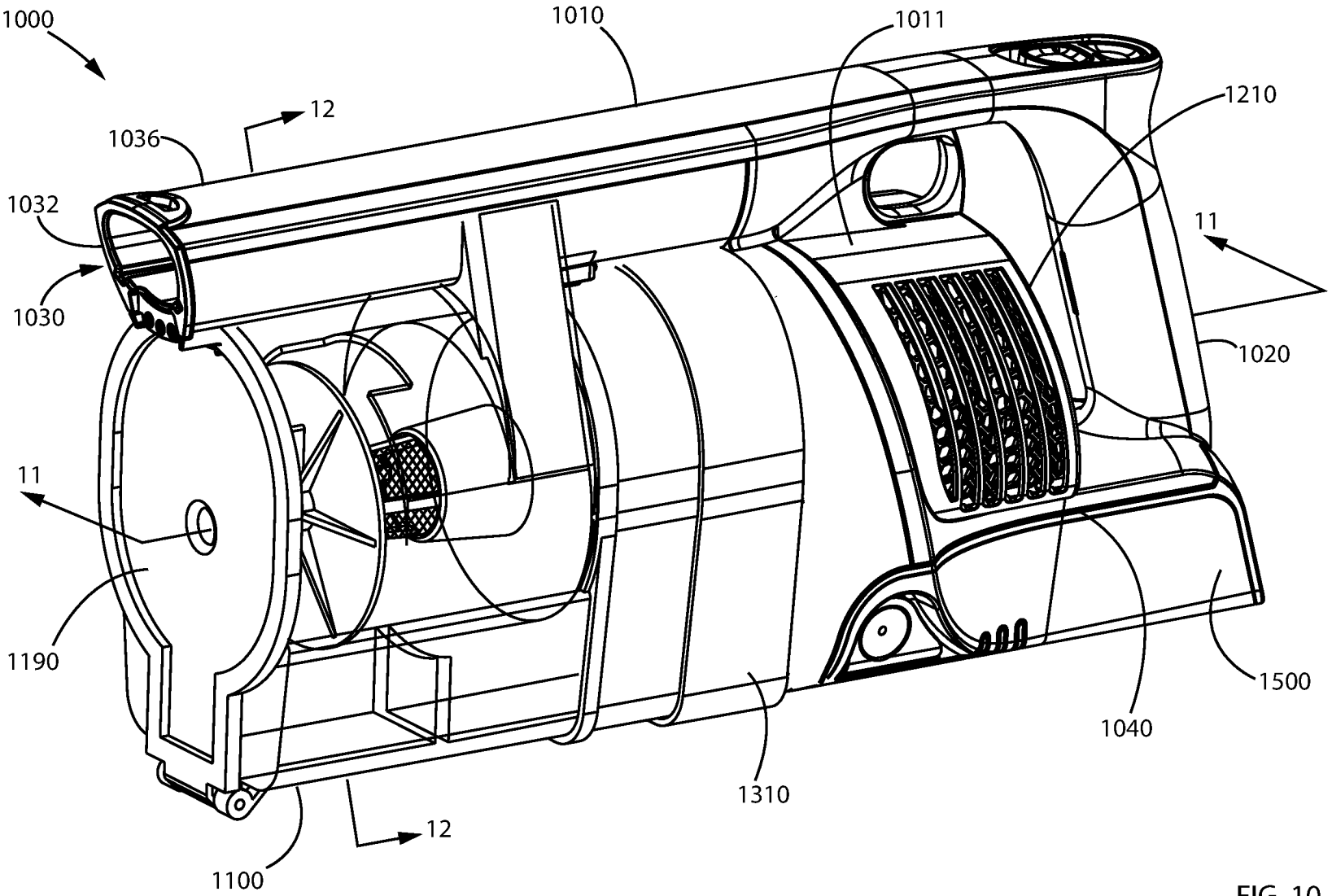
FIG. 10 is a top front perspective view of a hand vacuum cleaner in accordance with another embodiment.
Figure 12:
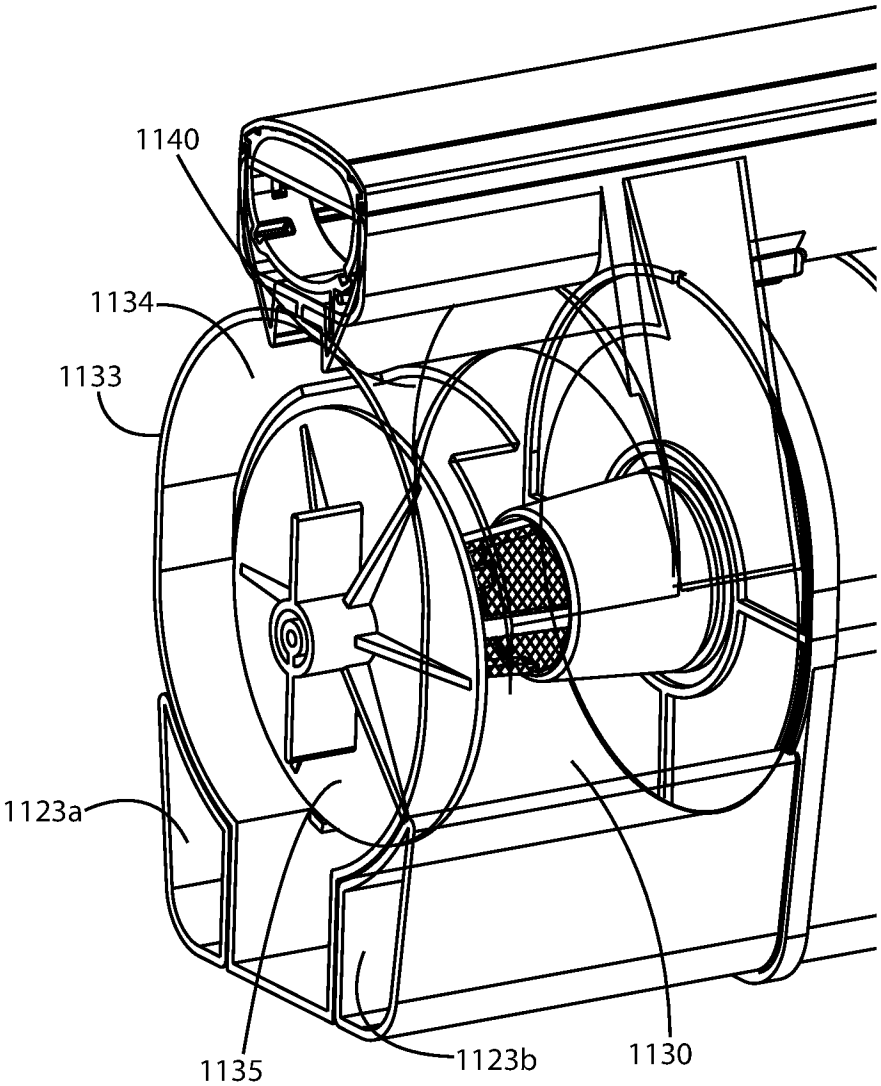
FIG. 12 is an isolated perspective sectional view of the hand vacuum cleaner of FIG. 10 along line 12-12 in FIG. 10 in accordance with the embodiment of FIG. 10.
Figure 13:
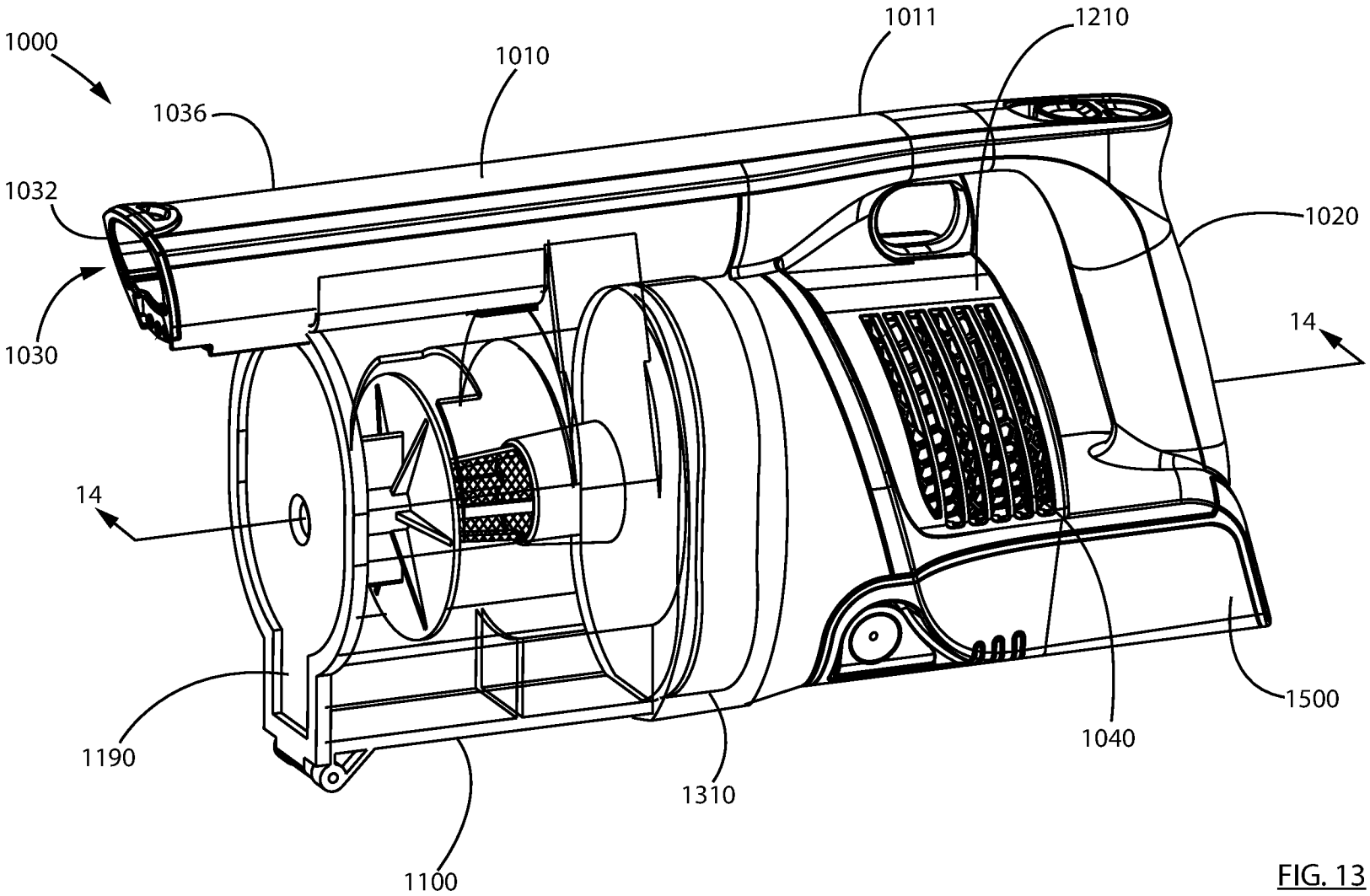
FIG. 13 is a top front perspective view of a hand vacuum cleaner in accordance with another embodiment.

Accordingly, for example, in the embodiments of FIGS. 6, 9 and 12, opening the front door also opens the second stage dirt collection chamber 1136. In the illustrated example, a user may hold the hand vacuum 1000 via the handle 1020 with one hand and open the front door 1190 with the other hand. The front end wall 1160 of the cyclone chamber 1130 and the front end wall 1126 of the dirt collection chamber 1134 (and the dirt collection chamber 1136 in the embodiment of FIG. 4) may be concurrently openable and may cover all of a substantial portion of the front end of the cyclone chamber and the dirt collection chamber(s). For example, the front end wall 1160 of the cyclone chamber 1130 and the front end wall 1126 of the dirt collection chamber 1134 (and optionally the front end wall of the second stage dirt collection chamber(s)) may be a one piece assembly (i.e. they may be integrally formed).

Alternately, the front end wall 1126 of the dirt collection chamber 1134 (and optionally also the dirt collection chamber 1136) may be separate from the front end wall 1160. For example, as exemplified in FIG. 4, the front end wall 1126 of the dirt collection chambers 1134, 1136 may be defined by the openable door 1190 while the front end wall of the cyclone chamber 1160 is defined by an arrester plate 1135 connected to door 1190. Alternately, as exemplified in FIG. 8, the front end wall 1126 of the dirt collection chamber 1134 may be defined by the openable door 1190 while the front end wall of the cyclone chamber 1160 is defined by an arrester plate 1135 connected to door 1190.

The front door 1190 may be openably connected (e.g., pivotally openable or removably mounted) to the rest of the cyclone assembly using any suitable mechanism, including a hinge or other suitable device. Optionally, the front door 1190 may be secured in the closed position using any suitable type of locking mechanism, including a latch mechanism that may be released by a user.

Alternately or in addition, the air treatment member 1100 may be removably mounted to main body 1010. For example, the air treatment member 1100 may be removably mounted to main body 1010 at a location forward of the energy storage unit 1500. Removing the air treatment member 1100 may facilitate emptying and/or cleaning. This may provide greater access to the rear portion of the air treatment member 1100, e.g. as the rear portion may be spaced apart from the front openable door 1190. This may also facilitate access to a second stage cyclone unit 1132 in the embodiment of FIG. 8 and/or the pre-motor filter chamber.

Optionally, one or more pre-motor filters may be placed in the air flow path between the air treatment member 1100 and the suction motor 1200. As shown in the examples of FIGS. 7-16, hand vacuum cleaner 1000 may include a pre-motor filter housing 1310 provided in the air flow path downstream of the air treatment member 1100 and upstream of the suction motor 1200. Pre-motor filter housing 1310 may be of any suitable construction, including any of those exemplified herein. One or more pre-motor filters 1320 may be positioned within the pre-motor filter housing 1310. Pre-motor filter(s) 1320 may be formed from any suitable physical, porous filter media and having any suitable shape, including the examples disclosed herein with respect to a removable pre-motor filter assembly. For example, the pre-motor filter may be one or more of a foam filter, felt filter, HEPA filter, other physical filter media, electrostatic filter, and the like.

Optionally, a secondary pre-motor filter 1322 may also be provided. The pre-motor filter housing 1310 may house both an upstream filter 1320 and a downstream filter 1322 (see e.g. FIGS. 8, 14 and 16). For example, upstream filter 1320 may include a foam filter medium while the downstream filter 1322 includes a felt filter medium.

Optionally, the pre-motor filter 1320 (and optional filter 1322) may be removable. For example, filter housing 1310 may include a removable or otherwise openable door to provide access to the interior of the pre-motor filter housing 1310.

Optionally, the pre-motor filter 1300 may be removable from the main body 1010 with the air treatment member 1100. For example, the pre-motor filter housing 1310 and air treatment member 1100 may be detachably mounted to the main body.

Optionally, the pre-motor filter 1300 may remain in place with the main body 1010 when the air treatment member 1100 is removed. For example, the air treatment member 1100 may be detachably mounted by itself to the main body.

The air treatment member 1100 and, optionally, also the pre-motor filter 1300 may together define a removable air treatment unit. As illustrated, the removable air treatment unit may be located forward of the energy storage unit. Removing the air treatment member 1100 and pre-motor filter 1300 may facilitate cleaning and maintenance of the hand vacuum cleaner 1000, as these components are often most likely to collect dirt and debris.

In the illustrated embodiment, the dirty air inlet 1030 of the hand vacuum cleaner 1000 is the inlet end 1032 of an inlet conduit 1036. Optionally, inlet end 1032 of the conduit 1036 can be used as a nozzle to directly clean a surface. The air inlet conduit 1036 is, in this example, a generally linear hollow member that extends along an inlet conduit axis 1035 that is oriented in a longitudinal forward/backward direction and is generally horizontal when hand vacuum cleaner 1000 is oriented with the upper end 1006 above the lower end 1008. Alternatively, or in addition to functioning as a nozzle, inlet conduit 1036 may be connected or directly connected to the downstream end of any suitable accessory tool such as a rigid air flow conduit (e.g., an above floor cleaning wand), a crevice tool, a mini brush, and the like. Optionally, dirty air inlet 1030 may be positioned forward of the air treatment member 1100, although this need not be the case. As exemplified, the dirty air inlet 1030 is positioned above the cyclone chamber 1130. Optionally, the dirty air inlet 1030 may be provided at an alternative location, such as in the front end wall 1160.

In the illustrated embodiment, the air inlet conduit 1036 is located above (e.g., closer to the upper end 1006 than) the cyclone axis 1115. The air inlet conduit 1036 may be spaced from the axis 1115 by a distance selected to be large enough that the air inlet conduit 1036 is above the air treatment member 1100, and is therefore above the first stage cyclone 1130, the second stage cyclone 1132 and their respective axes and other features. This may help facilitate using a generally linear air flow conduit 1036, which may help facilitate air flow through the apparatus 1000. Alternatively, the distance may be selected so that the inlet conduit 1036 is above the cyclone axes, but at least partially overlaps (i.e., an projection of part or all of the conduit may pass through one or both of the first and second stage cyclone) the first stage cyclone 1130 and/or the second stage cyclone 1132 in the up/down direction. This may help reduce the overall height of the apparatus 1000.

Figure 3:
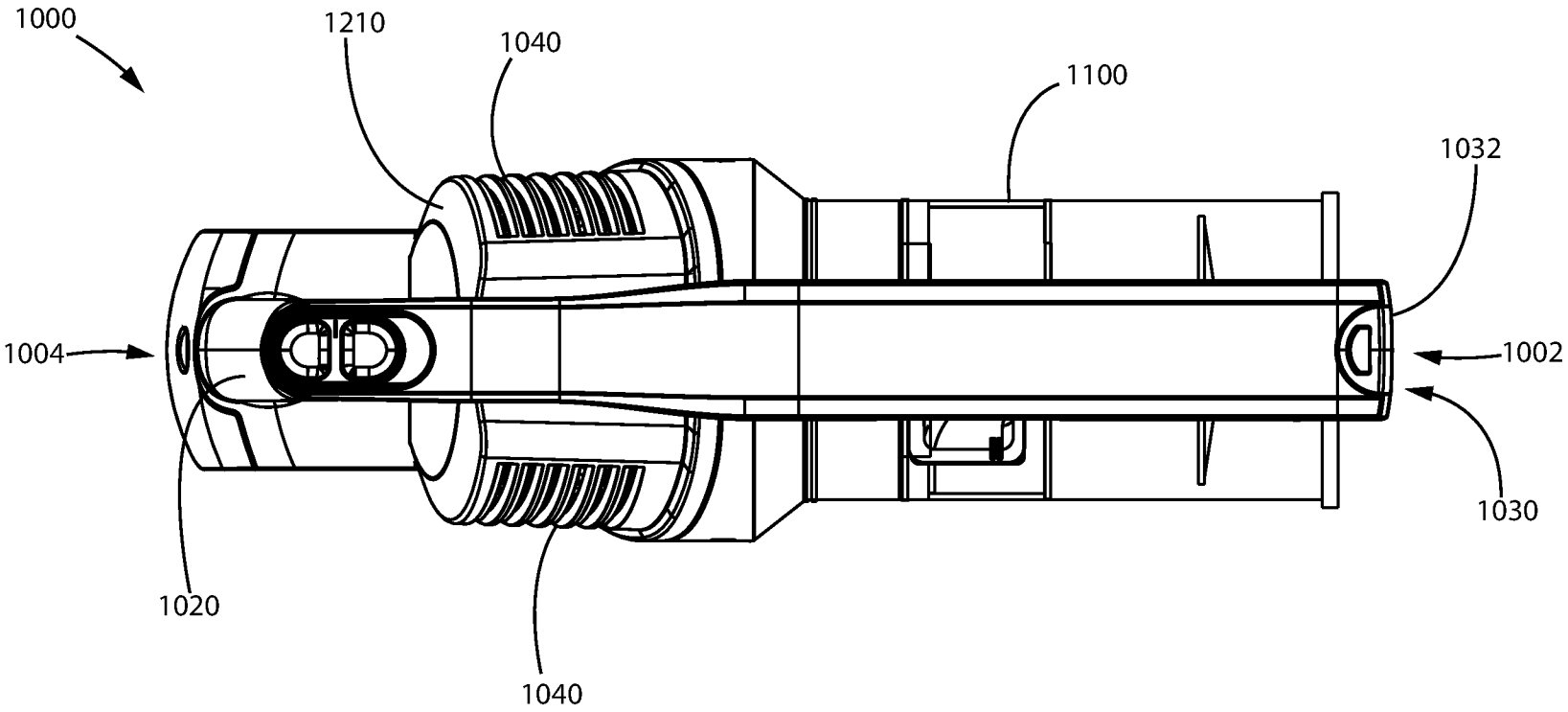
FIG. 3 is a top view of the hand vacuum cleaner of FIG. 1 in accordance with the embodiment of FIG. 1.

In the illustrated example, the clean air outlet 1040 is provided as part of the main body 1010, and includes a grill. As illustrated in FIG. 3, the clean air outlet 1040 may be provided on both lateral sides of the main body 1010. In this example, the grill is oriented such that air exiting the clean air outlet 1040 travels laterally outward from the main body 1010 (e.g., in a direction perpendicular to the cyclone 1115). This may ensure that the exhausted air is directed away from a user's hand when they are holding the handle 1020 rearward of the clean air outlet 1040. Alternately, the clean air outlet may be oriented such that the exhausted air travels generally rearwardly from the rear end 1004 of the hand vacuum 1000 (in a direction parallel to the cyclone axis 1115).

Optionally, one or more post-motor filters may be positioned in the air flow path between the suction motor 1200 and the clean air outlet 1040 to help further treat the air passing through the hand vacuum 1000. The post-motor filter may be formed from any suitable physical, porous filter media and having any suitable shape for filtering air in the airflow path downstream of the suction motor 1200. The post-motor filter may be any suitable type of filter such as one or more of a foam filter, felt filter, HEPA filter, other physical filter media, electrostatic filter, and the like. The clean air outlet 1040 may form part of an optional post-motor filter housing.

In the example illustrated, the suction motor axis 1205 is generally parallel to the cyclone axes and to the inlet conduit axis 1035. As exemplified, the motor axis 1205 may be also positioned so that the axis 1205 intersects one or more of the pre-motor filter housing 1310, the first stage cyclone 1130, second stage cyclone 1132, and front end walls 1160 and 1126.

Optionally, motor axis 1205 may be generally co-axial with one or both of the cyclone axes. This may help provide a desirable hand feel to a user.

As exemplified, the main body 1010 may be configured such that the suction motor housing 1210 is located rearward of the pre-motor filter housing 1310 and, preferably, axially aligned with the pre-motor filter housing 1310 such that air exiting the pre-motor filter may travel generally linearly to the suction motor. It will be appreciated that suction motor housing 1210 and pre-motor filter housing 1310 may be of any configuration. The diameter of the front portion of the suction motor housing 1210 may be about the same as the rear side of the pre-motor filter housing 1310 such that the pre-motor filter may have an upstream header that is about the diameter of the pre-motor filter and a downstream header that is about the diameter of the pre-motor filter.

The hand vacuum cleaner 1000 can include a handle 1020. As shown in the examples illustrated, the handle 1020 may be located at the rear end 1004 of the hand vacuum cleaner 1000. Alternately, the handle 1020 may be located at other suitable positions on the hand vacuum cleaner, such as the upper end 1006.

In the examples illustrated, the handle 1020 is a pistol grip type handle with an elongate pistol-grip style hand grip portion 1026 that extends upwardly and forwardly along a hand grip axis 1025 (FIG. 2) between upper and lower ends 1022 and 1024, when the hand vacuum 1000 is oriented so that the upper end 1006 is disposed above the lower end 1008. As exemplified in FIG. 2, a rearwardly extending bridge portion 1027 extends from the rear end of the inlet nozzle to the upper end 1022 of the handle 1020 and a rearwardly extending bridge portion 1029 extends rearwardly of the motor housing 1210 to the lower end 1024 of the handle 1020.

In this configuration, a finger gap or finger grip area 1028 for receiving the fingers of a user is formed between the hand grip 1026 and the main body 1010. As shown in FIG. 4 for example, the finger grip area 1028 may be positioned between the rear of the suction motor 1200 and the front of the handle 1020.

In the example illustrated, the finger grip area 1028 is partially bounded by the hand grip 1026, the upper end 1022 of the handle, the lower end 1024 of the handle, the upper and lower bridge portions 1027, 1029 and the suction motor housing 1210. In this configuration, a rearward projection of the cyclone chamber axis 1115 intersects the hand grip 1026 and the finger gap 1028, as well as passing through the suction motor housing 1210, pre-motor filter housing 1310 (in the embodiments of FIGS. 7-16), and second stage cyclone 1132 (in the embodiments of FIGS. 1-12).

Optionally, power can be supplied to the surface cleaning apparatus 1000 by an electrical cord connected to the hand vacuum that may be connected to a standard wall electrical outlet. The cord may optionally be detachable from the hand vacuum 1000.

Alternatively, or in addition, the power source for the surface cleaning apparatus 1000 may be or comprise an onboard energy storage device which may include, for example, one or more batteries. In the example illustrated, the hand vacuum 1000 includes an onboard energy storage unit 1500. The energy storage unit 1500 can include one or more energy storage members 1520, such as one or more batteries or other energy storage device.

The hand vacuum cleaner may include a power switch that is provided to selectively control the operation of the suction motor (e.g. either on/off or variable power levels or both), for example by establishing a power connection between the energy storage members 1520 and the suction motor 1200. The power switch may be provided in any suitable configuration and location, including a button, rotary switch, sliding switch, trigger-type actuator and the like.

Optionally, the inlet conduit 1036, or other portion of the apparatus 1000, may be provided with any suitable electrical connector that can establish an electrical connection between the apparatus 1000 and any accessory tool, cleaning head and the like that is connected to the inlet conduit 1036. In such a configuration, the hand vacuum 1000 may be used to power a surface cleaning head having a rotating brush, or other tools of that nature, using either power supplied by the wall outlet and/or the onboard battery pack 1500.

As shown in the example of FIG. 4, the energy storage unit 1500 extends between a front end 1502 and a rear end 1504. The energy storage unit 1500 may have a housing 1510 that is attached to the main body 1010. Optionally, energy storage unit 1500 may be removably mounted to the main body 1010 (e.g., removable from a position below the motor housing 1210 and the lower bridge portion 1029). For example, the housing 1510 may be detached from the main body 1010 to allow the energy storage members 1520 to be charged and/or replaced. Alternatively or in addition, the energy storage members 1520 may be charged while attached to main body 1010, e.g. using an electrical cord attached to the hand vacuum cleaner 1000. If the energy storage unit is not removably mounted, it may provide lower bride portion 1029.

The housing 1510 can enclose a plurality of energy storage members 1520. Each energy storage member may be, for example, a battery or a capacitor, such as a super capacitor. Alternately, the housing 1510 may enclose only a single energy storage member 1520.

In some examples, the energy storage members 1520 can be distributed between the front end 1502 and rear end 1504 of the energy storage unit 1500. In the examples illustrated, the energy storage members 1520 are arranged in a single row that extends in a forward/rearward direction. Alternately, energy storage members 1520 may be vertically and/or transversely oriented within the energy storage unit 1500 and/or two or more rows of energy storage members 1520 may be provided.

As shown in the illustrated examples (e.g., FIG. 4), a line 1535 that extends through at least some of the energy storage members 1520 may be substantially parallel to the cyclone axis 1115. As shown in FIG. 4, line 1535 may extend substantially in a forward/rearward direction, e.g., through a centre of the vertical height of the energy storage members 1520. This may help distribute the weight of the energy storage members 1520 in the forward/rearward direction.

Each of the energy storage members 1520 may have a longitudinal energy storage member axis 1525 (see e.g. FIG. 8). As shown in FIG. 8, the energy storage members 1520 can be oriented within the energy storage unit 1500 with the longitudinal energy storage member axis 1525 extending transverse to the air treatment member axis 1115. The weight of the individual energy storage members 1520 may thus be distributed laterally across the hand vacuum cleaner 1000.

In the example illustrated, the energy storage unit 1500 is provided at the lower end 1008 of the hand vacuum cleaner 1000. In other embodiments, one or more battery packs 1500 may be provided in other portions of the main body 1010 to provide power to the suction motor 1200, such as, for example, a battery pack that is provided within a hand grip portion 1026 of the handle 1020 or a compartment positioned on a front side of the handle 1020.

The energy storage unit 1500 (and the energy storage members 1520 enclosed therein) may be positioned below the suction motor 1200. This may help distribute the weight of the heavier components of the hand vacuum cleaner 1000 in the vertical direction. As shown in FIG. 8 for example, the suction motor 1200 is located on top of (i.e. overlying) a subset of the energy storage members 1520.

Alternately, all of the energy storage members 1520 may be positioned to underlie the suction motor 1200.

Alternately, the energy storage members 1520 may be spaced apart from the suction motor 1200 in the forward/rearward direction. For example, the energy storage members 1520 may underlie the finger grip area 1028 and/or handle 1020.

In the examples illustrated, the energy storage unit 1500 is positioned below the handle 1020. As shown in FIG. 8 for example, the handle 1020 is located on top of (i.e. overlying) a subset of the energy storage members 1520. This may provide a good hand feel for a user wielding the handle 1020, with the weight of the energy storage members 1520 below the handle 1020.

Alternately, all of the energy storage members 1520 may be positioned to underlie the handle 1020.

Alternately, the energy storage members 1520 may be spaced apart from the handle 1020 in the forward/rearward direction. For example, the energy storage members 1520 may underlie the finger grip area 1028 and/or suction motor 1200.

Optionally, the energy storage members 1520 may be positioned so that at least one of the energy storage members 1520 underlies the suction motor 1200 and at least another of the energy storage members 1520 underlies the pistol grip handle 1020.

As shown in the examples illustrated, the handle 1020 may be located at the rear end 1004 of the vacuum cleaner 1000 with the energy storage unit 1500 positioned under all (or some) of the lower end 1008. The suction motor 1200 can be located above (e.g. on top of or overlying) the front end 1502 of the energy storage unit 1500 and the pistol grip handle 1020 can be located above the rear end 1504 of the energy storage unit 1500. This distribution of the weight of the heavier components of the hand vacuum cleaner 1000, relative to the handle 1020, may help provide a desirable hand feel to a user.

Additionally or alternately, the finger grip area 1028 may be positioned above (e.g. on top of or overlying) the energy storage unit 1500. As shown in the illustrated examples, the finger grip area 1028 may be positioned between the front and rear ends 1502 and 1504 of the energy storage unit 1500.

As shown, the suction motor 1200, energy storage unit 1500, and handle 1020 may be provided with a generally u-shaped distribution around the finger grip area 1028. This may provide a good weight distribution that can be easily supported by a user holding the handle 1020. In such a configuration, it will be appreciated that the suction motor may be oriented such that the suction motor axis need not be forward/rearward but may be vertical or angled upwardly and forwardly (e.g., line the piston grip portion of the handle).

In some examples, the pre-motor filter 1300 may be located forward of the energy storage unit 1500. For example, a forward projection of the energy storage unit 1500 may intersect the pre-motor filter 1300 (see e.g. FIG. 8). This may help provide a compact configuration for the hand vacuum cleaner.

Figure 2:
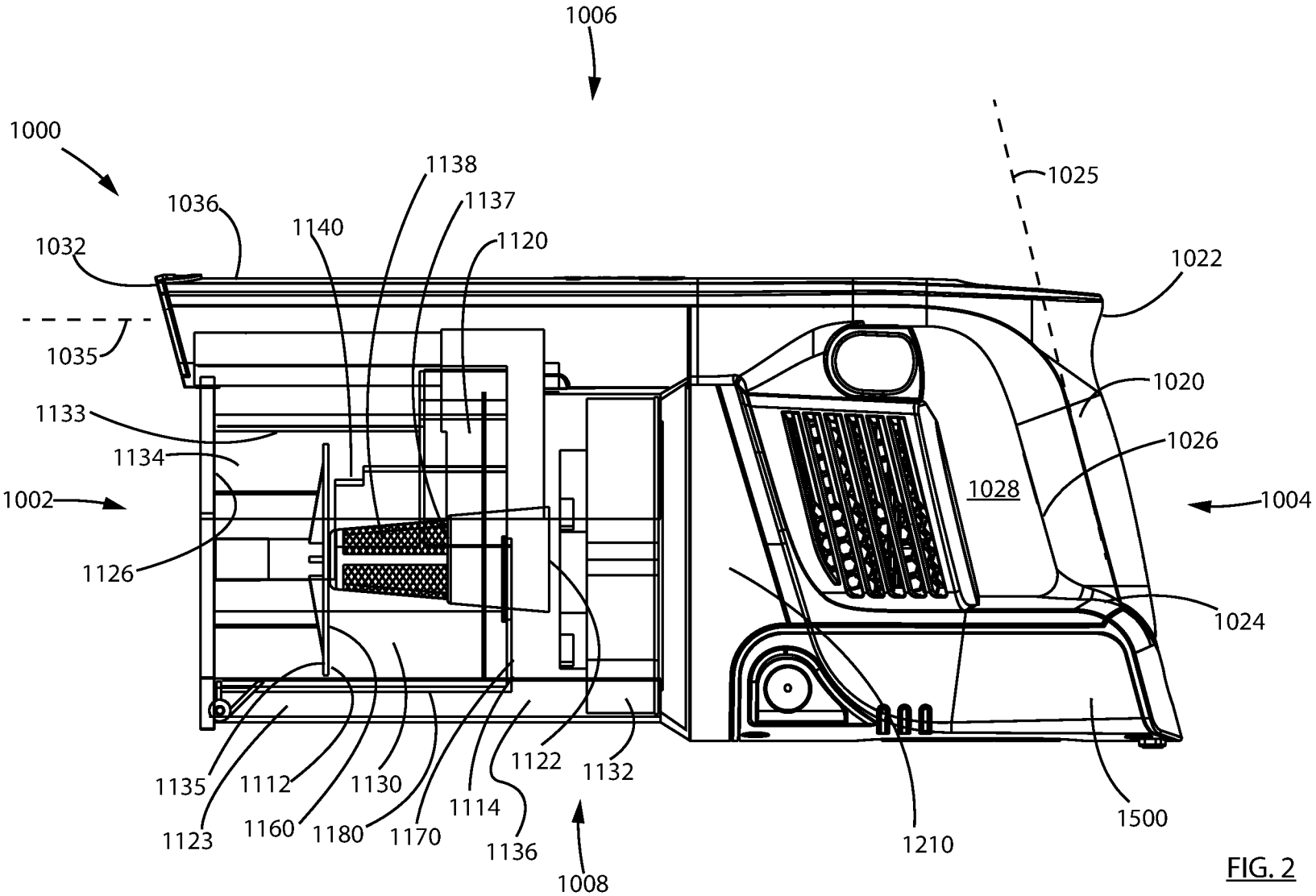
FIG. 2 is a side view of the hand vacuum cleaner of FIG. 1 in accordance with the embodiment of FIG. 1.

In the example illustrated, cyclone chamber 1130 extends between a front end 1112 and a rear end 1114 (see e.g. FIG. 2). In the examples illustrated, the cyclone chamber 1130 has a front end wall 1160 and an opposing rear end wall 1170 that is spaced apart from the front end wall 1160. The cyclone axis 1115, about which air circulates within the cyclone chamber 1130 during operation of the hand vacuum cleaner, extends between the front end 1112 (and front end wall 1160) and the rear end 1114 (and rear end wall 1170) of the cyclone chamber 1130. A cyclone chamber sidewall 1180 extends between the front and rear end walls 1160, 1170.

Optionally, as exemplified, when the hand vacuum is oriented with the upper end above the lower end, the cyclone axis 1115 is generally horizontal, and is closer to horizontal than vertical, e.g., ±20°, ±15°, ±10°, or ±5° from the horizontal. Optionally, as exemplified, the cyclone axis 1115 is substantially parallel to, e.g. within ±20°, ±15°, ±10°, or ±5°, and vertically offset below the conduit axis 1035 of the air inlet conduit 1036, and the cyclone chamber 1130 and dirt collection chamber 1134 are both below the inlet conduit axis 1035. As illustrated, a rearward extension of the conduit axis 1035 may intersect the upper end 1022 of the handle 1020.

In the example illustrated, the cyclone air inlet 1120 is a tangential air inlet that, as exemplified, terminates at an aperture or port that is formed in cyclone sidewall 1180, optionally an upper portion of the cyclone sidewall 1180, adjacent the rear end wall 1170. Optionally, the cyclone air inlet 1120 may be provided at an alternative location, such as in the front end wall 1160 or adjacent the front end wall 1160.

The cyclone air inlet 1120 is fluidly connected with the outlet end of the conduit 1036 via a corresponding air outlet aperture or port 1038 that may be provided in a lower portion of the air inlet conduit 1036. The cyclone air inlet 1120 may have any suitable arrangement and/or configuration, and in the illustrated example is configured as a tangential air inlet that is directly connected to the air outlet aperture 1038. Connecting the air inlet 1120 to the air outlet aperture 1038 in this manner may help reduce the need for additional conduits to fluidly connect the dirty air inlet 1030 to the cyclone chamber 1130, and may reduce or eliminate the need for additional bends or air flow direction changes between the dirty air inlet 1030 and the cyclone chamber 1130. Reducing the conduit length and number of bends may help reduce the backpressure and air flow losses within the 1100 air flow path.

Optionally, as exemplified in FIG. 2, the cyclone air outlet 1122 is provided in the rear end wall 1170 of the cyclone chamber 1130, and an axially extending vortex finder conduit 1137 extends from the rear end wall 1170 and is aligned with the cyclone air outlet 1122. Optionally, a mesh screen (not shown) may provide some or all of the inlet apertures 1138 of the vortex finder conduit 1137 to help inhibit lint, hair, and other such debris from entering the vortex finder conduit 1137. Positioning the air outlet 1122 comprising a porous section (e.g., a mesh screen or a shroud) toward the rear end (and optionally in the rear end wall 1170) may help facilitate the desired air flow through the cyclone chamber 1130, such that air, while swirling, travels generally axially though the cyclone chamber 1130 from the front end wall 1160 toward the rear end wall 1170.

Positioning the air outlet 1122 in the rear end wall 1170 of the cyclone chamber 1130 may also help facilitate a low back pressure air flow connection between the cyclone chamber 1130 and a downstream component in the hand vacuum 1000, such as a second stage cyclone unit 1132 or a pre-motor filter.

In this arrangement, air travelling through the hand vacuum 1000 will travel generally rearwardly along the air inlet conduit 1036 (i.e. parallel to the conduit axis 1035 and then enter a tangential air inlet which essentially changes the direction of the air to travel generally downwardly through the cyclone air inlet 1120 (i.e. generally orthogonal to the cyclone axis 1115). The air can then circulate within the cyclone chamber 1130, and ultimately exit the cyclone chamber 1130 via the cyclone air outlet 1122 while travelling through the vortex finder conduit 1137 in a rearward direction (i.e. generally parallel to the cyclone axis 1115).

From the cyclone air outlet 1122 air travels rearwardly towards the suction motor 1200. After passing through the second stage cyclone unit 1132 and/or pre-motor filter 1320, air may travel generally rearwardly to an inlet end of the suction motor 1200. An advantage of this arrangement is that, by promoting air to travel in this manner, the need for air flow direction changes between an air outlet of the air treatment member 1100 and the suction motor may be reduced or eliminated, thereby reducing backpressure and/or air flow losses through this portion of the hand vacuum cleaner 1000.

The cyclone dirt outlet 1140 may be of any suitable configuration, for example as shown in the example of FIGS. 1-7 the dirt outlet is a slot 1140 that is provided in the cyclone chamber side wall 1180, toward the front end wall 1160. The slot 1140 may extend around at least a portion of the perimeter of the cyclone side wall 1180. While shown directly adjacent the front end wall 1160, such that the slot 1140 is partially bounded by the cyclone side wall 1180 and the front end wall 1160, the slot 1140 may be located at another location along the length of the cyclone side wall 1180, and need not be directly adjacent the front end wall 1160. Alternatively, the dirt outlet 1140 may be provided toward the mid-point of the cyclone chamber sidewall 1180, or may be provided toward the rear end wall 1170.

Figure 14:
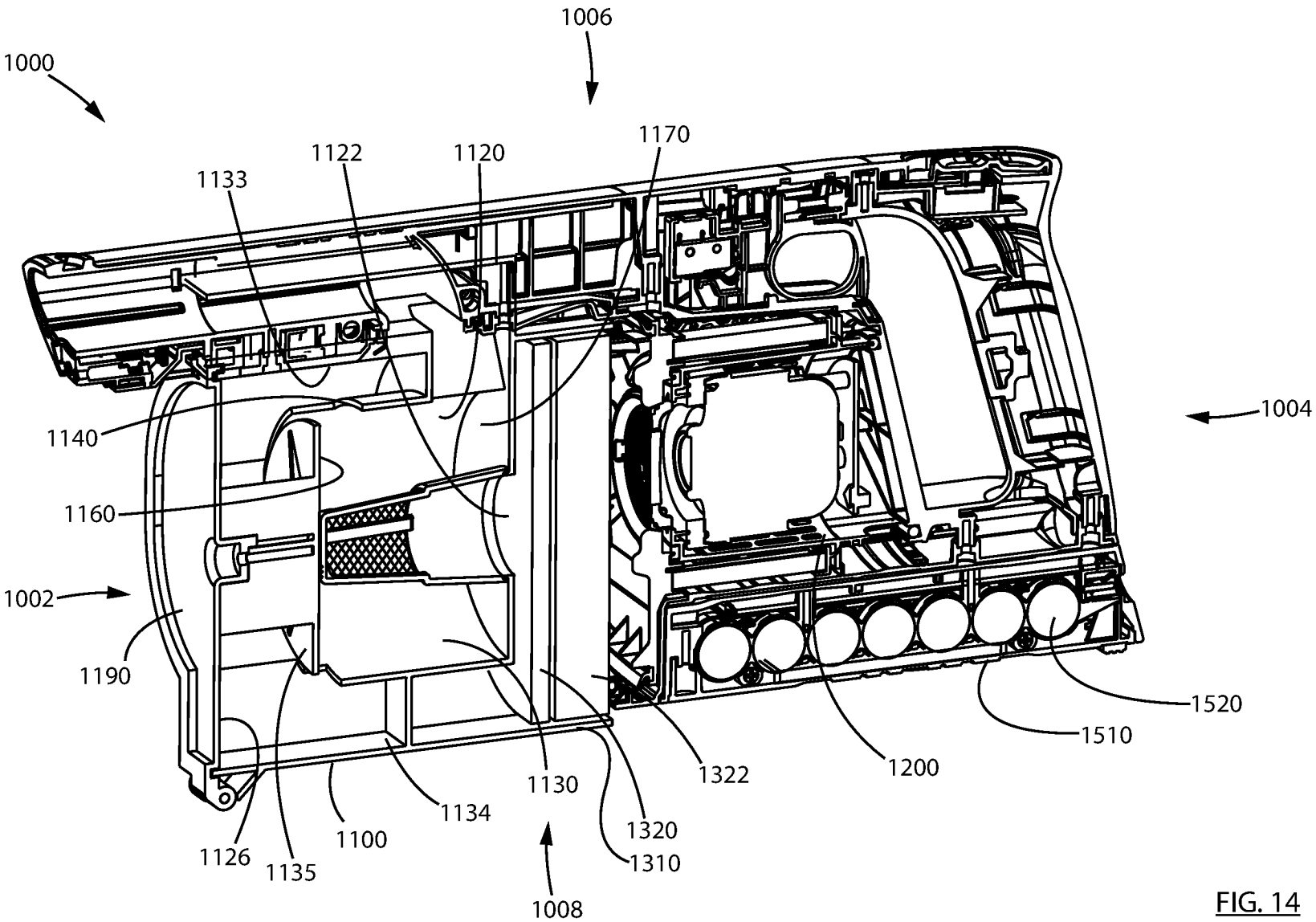
FIG. 14 is a perspective sectional view of the hand vacuum cleaner of FIG. 13 along line 14-14 in FIG. 13 in accordance with the embodiment of FIG. 13.
Figure 15:
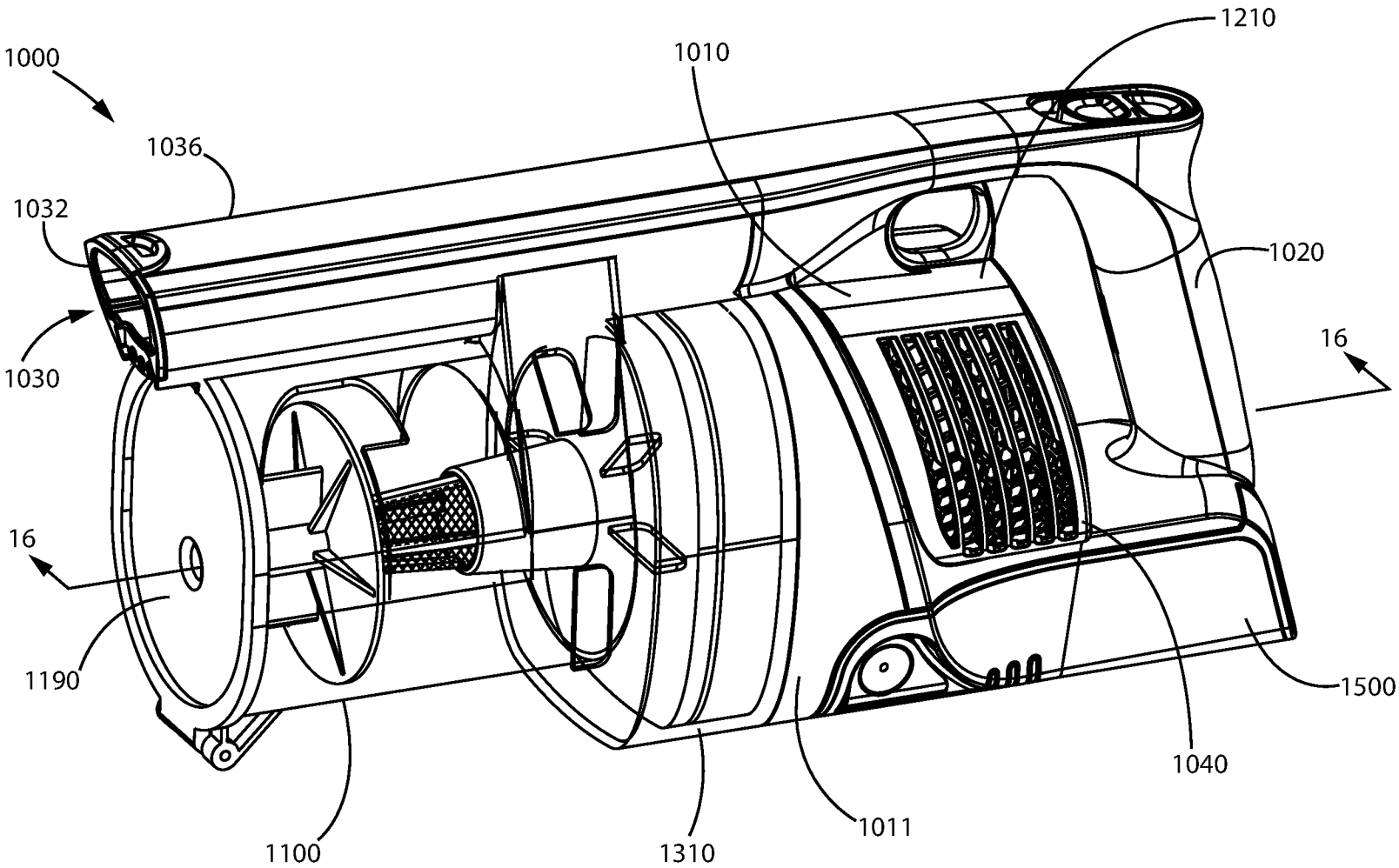
FIG. 15 is a top front perspective view of a hand vacuum cleaner in accordance with another embodiment.
Figure 16:
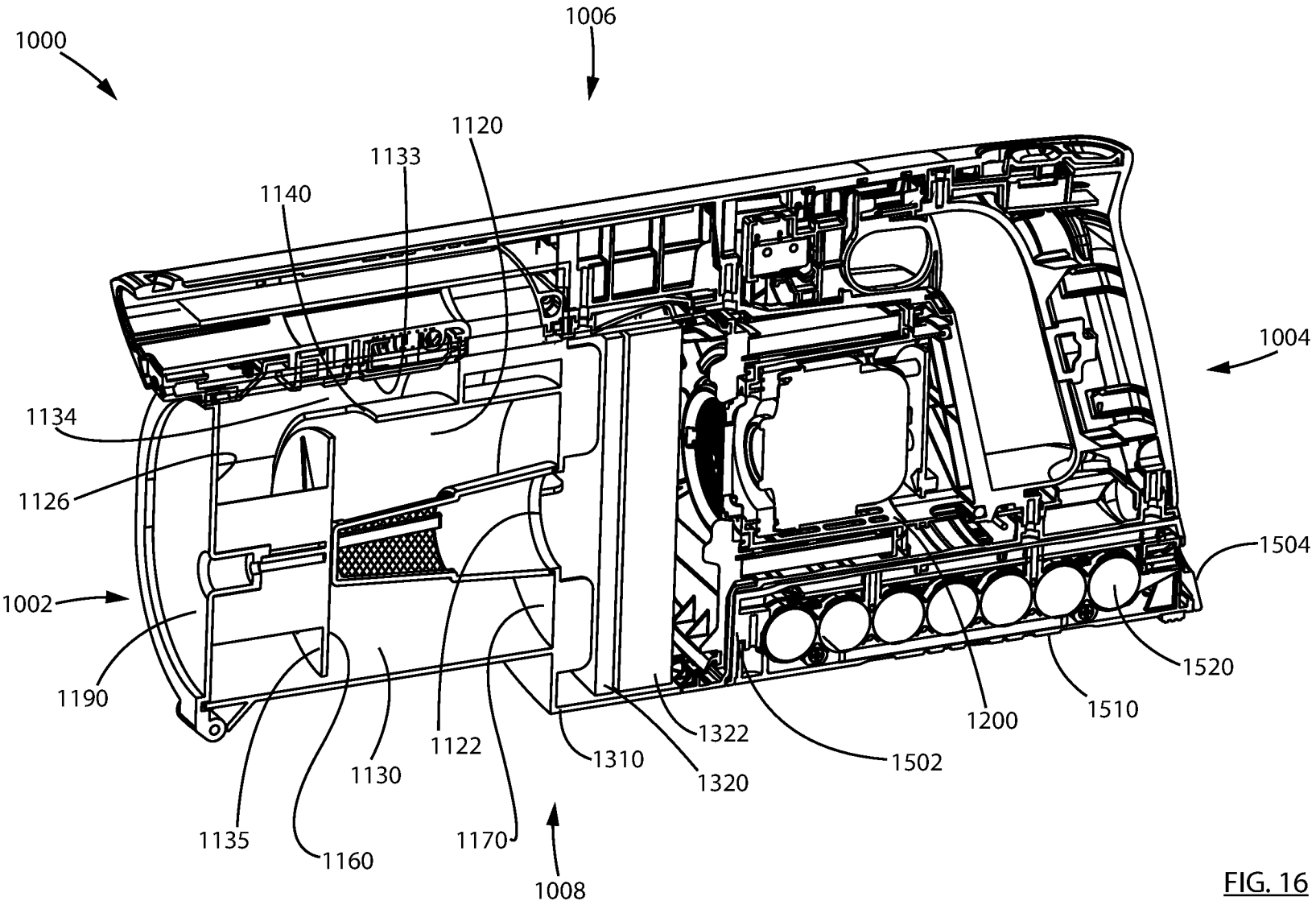
FIG. 16 is a perspective sectional view of the hand vacuum cleaner of FIG. 15 along line 16-16 in FIG. 15 in accordance with the embodiment of FIG. 15.

In the example illustrated by FIGS. 1-7, the cyclone chamber 1130 has a single dirt outlet 1140. Alternately, the cyclone chamber 1130 may include two or more dirt outlets that are in communication with the same dirt collection chamber, or optionally with different dirt collection chambers. For example, FIGS. 10-14 illustrate examples of the cyclone chamber 1130 that includes multiple dirt outlets 1140. As shown in the examples of FIGS. 11 and 14, the cyclone chamber 1130 may include an upper dirt outlet and a separate lower dirt outlet.

In the examples illustrated by FIGS. 10-14, the dirt outlets are in communication with a single dirt collection chamber 1134 that surrounds the cyclone chamber 1130. Alternately, the cyclone chamber 1130 may include multiple dirt outlets to different dirt collection chambers 1134. This may facilitate collection of different sizes of dirt and debris.

In the illustrated examples, the dirt collection chamber 1134 is external to the cyclone chamber 1130 and may at least partially surround the cyclone chamber 1130. It will be appreciated that if the second stage dirt collection chamber includes dirt collection chamber passages 1123, then the dirt collection chamber 1134 and the dirt collection chamber passages 1123 may at least partially surround the cyclone chamber 1130. In some examples, the dirt collection chamber 1134 (and the passages 1123 if any) may surround a majority or all of the cyclone chamber 1130. For example, the dirt collection chamber 1134 (and the passages 1123 if any) may surround at least 80%, 85%, 90%, 95% or all of the cyclone chamber 1130.

The perimeter of the air treatment member 1100 may define the majority (80% or 85% or 90% or 95% or more) or all of the height and width of hand vacuum cleaner 1000. For example, as shown in FIG. 9, the air treatment member 1100, and in particular the dirt collection chamber sidewall 1133 may occupy a substantial majority (at least 80%, 85%, 90%, 95%) or all of the height and width of the hand vacuum cleaner 1000.

In this configuration, a rearward projection of the outer sidewall of the air treatment member, which may be sidewall 1133 of the dirt collection chamber 1134 (if the dirt collection chamber 1134 surrounds the cyclone chamber 1130) may encompass the majority (at least 80%, 85%, 90%, 95%) or all of each of the components of the hand vacuum cleaner 1000.

As shown for instance by FIGS. 9-12, the rearward projection of the sidewall 1133 of the dirt collection chamber 1134 may substantially encompass the suction motor 1200, second stage cyclone unit 1132, pre-motor filter 1300, energy storage unit 1500, and handle 1020.

Alternately, as shown for instance by FIGS. 1-9, the rearward projection of the outer sidewall of the air treatment member (which comprises the outer wall of the passages 1123 and the dirt collection chamber sidewall 1133 of the dirt collection chamber 1134) may substantially encompass the suction motor 1200, second stage cyclone unit 1132, pre-motor filter 1300 (in the example of FIGS. 7-9), energy storage unit 1500, and handle 1020.

For example, as exemplified, the only components that may extend laterally outward from the rearward projection of the outer wall (e.g., sidewall 1133) may be the inlet conduit 1036, the upper end 1027 of handle 1020, and in some embodiments a lower section of the energy storage unit 1500. For example, the rearward projection of the outer wall (e.g., sidewall 1133) may encompass the suction motor 1200, second stage cyclone unit 1132, pre-motor filter 1300, the pistol grip portion of the handle 1020 and at least an upper portion of the energy storage unit 1500 (e.g., the projection of the sidewall 1133 may pass above line 1535, essentially along line 1535 or below line 1535).

In some embodiments, at least 80% or 85% or 90% or 95% of one or more of (or each of) the suction motor 1200, second stage cyclone unit 1132 (in the examples of FIGS. 1-12), pre-motor filter 1300 (in the examples of FIGS. 7-16), energy storage unit 1500, and handle 1020 may be located within the volume defined by a projection of the outer wall (e.g., sidewall 1133). This may help reduce the height of the vacuum cleaner 1100.

The air treatment member 1100 (including the optional second stage cyclone unit 1132), pre-motor filter 1300 (in the examples of FIGS. 7-16), and suction motor 1200 may be positioned with a substantially linear arrangement moving from the front end 1002 of the vacuum cleaner 1000 towards the rear end 1004. This may help reduce the number of turns in the airflow path through the hand vacuum cleaner 1000. This may also help provide a reduced profile to the hand vacuum cleaner 1000, with each of these components (as well as others such as the handle 1020 and energy storage unit 1500 for example) contained within the volume defined by a rearward projection of the perimeter of the air treatment member 1100 (which may in some cases be defined at least in part by sidewall 1133).

As used herein, the wording "and/or" is intended to represent an inclusive—or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A hand vacuum cleaner having an upper end, a lower end, a front end having a dirty air inlet and a rear end, the hand vacuum cleaner comprising:

(a) an air flow path extending from the dirty air inlet to a clean air outlet, wherein the dirty air inlet is provided at an upper end of the hand vacuum cleaner;

(b) a cyclone positioned in the air flow path, the cyclone having a cyclone front end, a cyclone rear end, a cyclone air inlet, a cyclone air outlet and a cyclone axis of rotation axis extending between the cyclone front end and the cyclone rear end;

(c) a dirt collection chamber external to the cyclone and surrounding at least 80% of the cyclone; and (d) a main body comprising a suction motor that is positioned in the air flow path, a plurality of energy storage members and a pistol grip handle, the pistol grip handle having an upper end and a lower end, the plurality of energy storage members are provided at the lower end of the hand vacuum cleaner, wherein a line that extends through the plurality of energy storage members is substantially parallel to the cyclone axis of rotation, and wherein when the hand vacuum cleaner is oriented with the upper end above the lower end, the suction motor is located rearward of a pre-motor filter, the pistol grip handle is located at the rear end of the hand vacuum cleaner and the plurality of energy storage members are located below a lower end of the suction motor, and wherein the pre-motor filter, the suction motor, the plurality of energy storage members and the pistol grip handle are substantially located within a volume defined by a projection of the dirt collection chamber sidewall.

2. The hand vacuum cleaner of claim 1, wherein when the hand vacuum cleaner is oriented with the upper end above the lower end, the energy storage members are located below the pistol grip handle.

3. The hand vacuum cleaner of claim 1, wherein when the hand vacuum cleaner is oriented with the upper end above the lower end, the energy storage members are located below the pistol grip handle.

4. A hand vacuum cleaner having an upper end, a lower end, a front end having a dirty air inlet and a rear end, the hand vacuum cleaner comprising:

(a) an air flow path extending from the dirty air inlet to a clean air outlet;

(b) a cyclone unit comprising a cyclone positioned in the air flow path and a dirt collection chamber, the cyclone having a cyclone first end, an opposed cyclone second end, a cyclone air inlet, a cyclone air outlet, a cyclone axis of rotation axis extending between the cyclone first end and the cyclone second end and an axially extending cyclone sidewall;

(c) the dirt collection chamber external to the cyclone and surrounding the cyclone; and (d) a main body comprising a suction motor that is positioned in the air flow path, an energy storage unit and a pistol grip handle, the pistol grip handle having an upper end and a lower end and an absence of energy storage members, wherein when the hand vacuum cleaner is oriented with the upper end above the lower end, the pistol grip handle is located rearward of the front end of the hand vacuum cleaner and the suction motor is located rearward of a pre-motor filter, and wherein the pre-motor filter, the suction motor, the energy storage unit and the pistol grip handle are substantially located within a volume defined by a projection of the cyclone unit, and wherein the energy storage unit comprises a plurality of energy storage members and a projection of the suction motor in a direction perpendicular to the cyclone axis of rotation intersects only some of the energy storage members.

5. The hand vacuum cleaner of claim 4, wherein the energy storage unit is provided at the lower end of the hand vacuum cleaner.

6. The hand vacuum cleaner of claim 4, wherein when the hand vacuum cleaner is oriented with the upper end above the lower end, the energy storage unit is located below the pistol grip handle.

7. The hand vacuum cleaner of claim 4, wherein the energy storage unit comprises a plurality of energy storage members and a line that extends through at least some of the energy storage members is substantially parallel to the cyclone axis of rotation.

8. The hand vacuum cleaner of claim 4, wherein the pistol grip handle is located at the rear end of the hand vacuum cleaner.

9. The hand vacuum cleaner of claim 4, further comprising an air inlet conduit extending downstream from the dirt air inlet, the air inlet conduit having an inlet conduit axis wherein a projection of the inlet conduit intersects the upper end of the handle.

10. The hand vacuum cleaner of claim 4, further comprising a second cyclonic stage downstream from the cyclone wherein the second cyclonic stage is located within the volume defined by the projection of the dirt collection chamber sidewall.

11. A hand vacuum cleaner having an upper end, a lower end, a front end having a dirty air inlet and a rear end, the hand vacuum cleaner comprising:

(a) an air flow path extending from the dirty air inlet provided at the front end of the hand vacuum cleaner to a clean air outlet and comprising an air inlet conduit extending downstream from the dirt air inlet, the air inlet conduit located at the upper end of the hand vacuum cleaner;

(b) a cyclone unit comprising a cyclone positioned in the air flow path and a dirt collection chamber external to the cyclone chamber, the cyclone having a a cyclone air inlet, a cyclone air outlet and a cyclone axis of rotation extending between the front end and the rear end, the cyclone unit having an axially extending sidewall, wherein when the hand vacuum cleaner is oriented with the upper end above the lower end, the cyclone unit has an upper end, a lower end and a midpoint located between the upper and lower ends of the cyclone unit; and (c) a main body comprising a suction motor positioned in the air flow path, an energy storage unit and a pistol grip handle located at the rear end of the hand vacuum cleaner, wherein when the hand vacuum cleaner is oriented with the upper end above the lower end, the suction motor is located rearward of a pre-motor filter and the energy storage unit is located below the midpoint of the cyclone unit of the hand vacuum cleaner, and wherein the hand vacuum cleaner has a height in a direction perpendicular to the cyclone axis of rotation from the upper end of the hand vacuum cleaner to a lower end of the cyclone unit and a projection of the height encompass the pre-motor filter, the suction motor, the energy storage unit and the pistol grip handle.

12. The hand vacuum cleaner of claim 11, wherein the dirty air inlet is provided at the upper end of the hand vacuum cleaner and the energy storage unit is located at a lower end of the hand vacuum cleaner and, when the hand vacuum cleaner is oriented with the upper end above the lower end, the energy storage unit is located below the pistol grip handle.

13. The hand vacuum cleaner of claim 11, wherein the energy storage unit comprises a plurality of energy storage members and a line that extends through at least some of the energy storage members is substantially parallel to the cyclone axis of rotation.

14. The hand vacuum cleaner of claim 11, wherein the energy storage unit comprises a plurality of energy storage members and a projection of the suction motor in a direction perpendicular to the cyclone axis of rotation intersects at least some of the energy storage members.

15. The hand vacuum cleaner of claim 11, further comprising a second cyclonic stage downstream from the cyclone wherein the second cyclonic stage is located within the volume defined by a projection of the cyclone unit.

16. The hand vacuum cleaner of claim 11, wherein the dirt collection chamber surrounds the cyclone chamber, the dirt collection chamber has a height in a direction perpendicular to the cyclone axis of rotation from an upper end of the dirt collection chamber to a lower end of the dirt collection chamber and a projection of the height of the dirt collection chamber encompass the pre-motor filter, the suction motor and the energy storage unit.

17. The hand vacuum cleaner of claim 11, wherein, the air inlet conduit has an inlet conduit axis wherein a projection of the inlet conduit intersects an upper end of the handle.

18. The hand vacuum cleaner of claim 17, wherein the energy storage unit comprises a plurality of energy storage members and a projection of the suction motor in a direction perpendicular to the cyclone axis of rotation intersects at least some of the energy storage members.

* * * * *